US007338363B2

(12) United States Patent
Okada

(10) Patent No.: US 7,338,363 B2
(45) Date of Patent: Mar. 4, 2008

(54) GAMING MACHINE, SERVER, AND PROGRAM

(75) Inventor: Kazuo Okada, Tokyo (JP)

(73) Assignee: ARUZE Co., Ltd. (JP)

( * ) Notice: Subject to any disclaimer, the term of this patent is extended or adjusted under 35 U.S.C. 154(b) by 595 days.

(21) Appl. No.: 10/686,567

(22) Filed: Oct. 17, 2003

(65) Prior Publication Data

US 2004/0147322 A1 Jul. 29, 2004

(30) Foreign Application Priority Data

Oct. 18, 2002 (JP) ..... 2002-304951

(51) Int. Cl.
*A63F 9/24* (2006.01)
*A63B 71/00* (2006.01)

(52) U.S. Cl. ..... 463/13; 463/20

(58) Field of Classification Search ..... 463/13, 463/20, 25, 26

See application file for complete search history.

(56) References Cited

U.S. PATENT DOCUMENTS

| | | | | |
|---|---|---|---|---|
| 5,116,055 | A | 5/1992 | Tracy | |
| 5,611,730 | A | 3/1997 | Weiss | |
| 6,110,041 | A * | 8/2000 | Walker et al. | 463/20 |
| 6,254,483 | B1 | 7/2001 | Acres | |
| 6,257,981 | B1 | 7/2001 | Acres et al. | |
| 6,319,122 | B1 | 11/2001 | Packes, Jr. et al. | |
| 6,354,943 | B1 | 3/2002 | Miura | |
| 2002/0138594 | A1 * | 9/2002 | Rowe | 709/219 |
| 2002/0183105 | A1 | 12/2002 | Cannon et al. | |
| 2005/0085300 | A1 * | 4/2005 | Johnson | 463/42 |
| 2006/0111186 | A1 * | 5/2006 | Hattori | 463/40 |

FOREIGN PATENT DOCUMENTS

| | | |
|---|---|---|
| JP | 6-134135 | 5/1994 |
| JP | 8-71203 | 3/1996 |
| JP | 11-76581 | 3/1999 |
| JP | 2000-189647 | 7/2000 |
| JP | 2000-227930 | 8/2000 |
| JP | 2000-262702 | 9/2000 |

(Continued)

OTHER PUBLICATIONS

Patent Abstracts of Japan, Publication No. 2001347042, Publication Date: Dec. 18, 2001.

*Primary Examiner*—Robert E. Pezzuto
(74) *Attorney, Agent, or Firm*—Antonelli, Terry, Stout & Kraus, LLP

(57) ABSTRACT

A slot machine is provided with specification value setting means for setting at least one specification value as a control condition when game control is carried out, total result data receiving means for receiving from a server the data of the total result of a game result achieved by a first gaming machine and a game result achieved by a second gaming machine, specification value determining means for determining the specification value on the basis of the data of the total result received by the total result data receiving means, and specification value renewing means for renewing the specification value set by the specification value setting means to the specification value determined by the specification value determining means. There is provided a slot machine for renewing the specification value on the basis of the total result of the game results achieved by the first and the second gaming machines.

27 Claims, 23 Drawing Sheets

FOREIGN PATENT DOCUMENTS

| | | |
|---|---|---|
| JP | 2001-198335 | 7/2001 |
| JP | 2001-347042 | 12/2001 |
| JP | 2002-15180 | 1/2002 |
| JP | 2002-282485 | 10/2002 |
| JP | 2002-360911 | 12/2002 |
| JP | 2003-79882 | 3/2003 |
| JP | 2003-190640 | 7/2003 |
| JP | 2003-230739 | 8/2003 |
| JP | 2003-230753 | 8/2003 |
| JP | 2003-230762 | 8/2003 |

* cited by examiner

Fig. 7

| | SET 1 | | | ··· | SET 6 | | |
|---|---|---|---|---|---|---|---|
| TOTAL RESULT | PROBABILITY 1 | PAYOUT 1 | PAYOUT RATE 1 | ··· | PROBABILITY 6 | PAYOUT 6 | PAYOUT RATE 6 |
| — | D1000 | E1000 | F11 | ··· | D6000 | E6000 | F61 |
| A1～A2 | D1100 | E1100 | F12 | ··· | D6100 | E6100 | F62 |
| A2～A3 | D1200 | E1200 | F13 | ··· | D6200 | E6200 | F63 |
| A3～A4 | D1300 | E1300 | F14 | ··· | D6300 | E6300 | F64 |
| A4～A5 | D1400 | E1400 | F15 | ··· | D6400 | E6400 | F65 |
| A5～ | D1500 | E1500 | F16 | ··· | D6500 | E6500 | F66 |

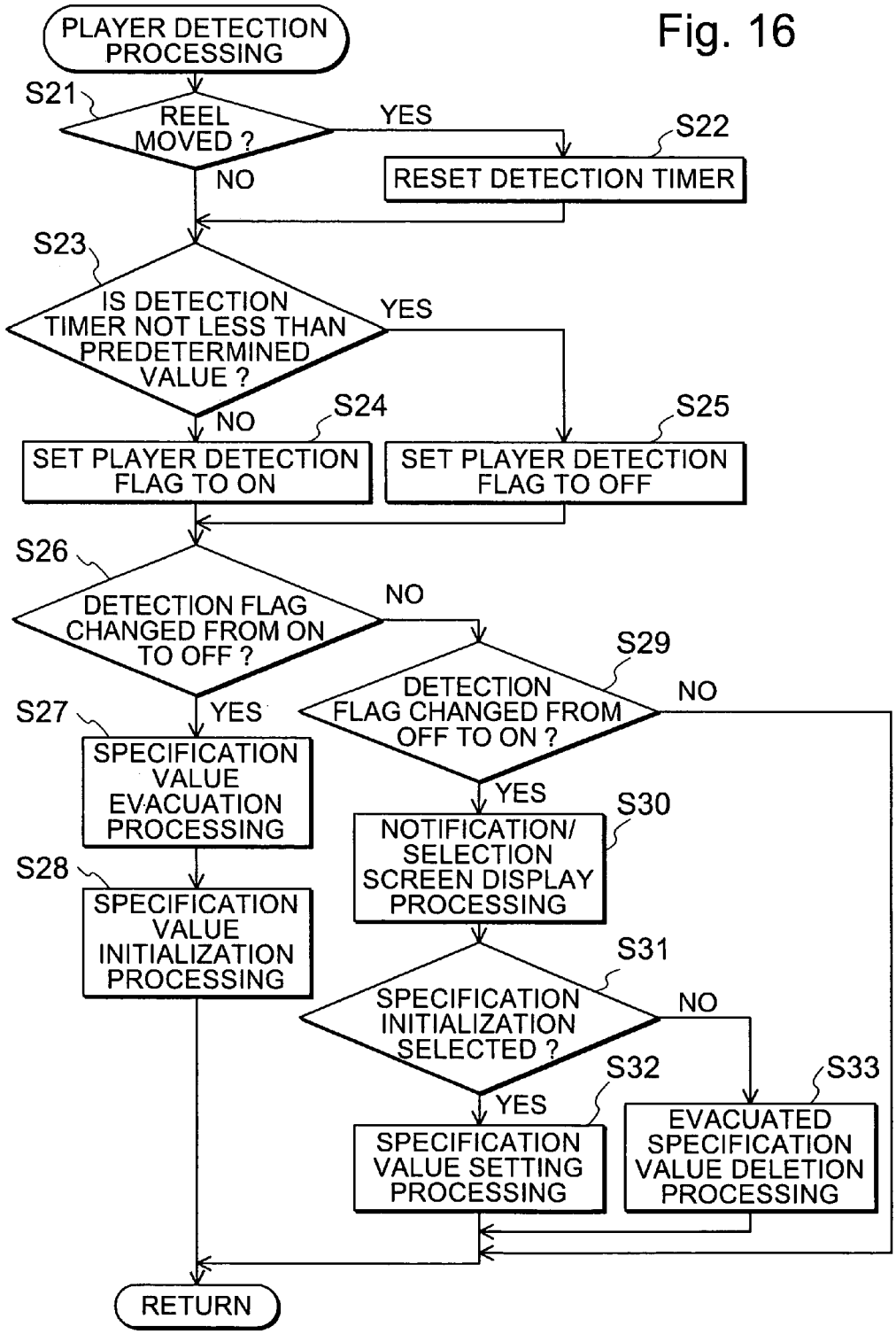
Fig. 16
PLAYER DETECTION PROCESSING
S21
REEL MOVED ?
YES
NO
S22
RESET DETECTION TIMER
S23
IS DETECTION TIMER NOT LESS THAN PREDETERMINED VALUE ?
YES
NO
S24
SET PLAYER DETECTION FLAG TO ON
S25
SET PLAYER DETECTION FLAG TO OFF
S26
DETECTION FLAG CHANGED FROM ON TO OFF ?
NO
YES
S27
SPECIFICATION VALUE EVACUATION PROCESSING
S28
SPECIFICATION VALUE INITIALIZATION PROCESSING
S29
DETECTION FLAG CHANGED FROM OFF TO ON ?
NO
YES
S30
NOTIFICATION/ SELECTION SCREEN DISPLAY PROCESSING
S31
SPECIFICATION INITIALIZATION SELECTED ?
NO
YES
S32
SPECIFICATION VALUE SETTING PROCESSING
S33
EVACUATED SPECIFICATION VALUE DELETION PROCESSING
RETURN

Fig. 23 A

| TOTAL RESULT | CHANGE |
|---|---|
| A1～A2 | −2 |
| A2～A3 | −1 |
| A3～A4 | ±0 |
| A4～A5 | −1 |
| A5～A6 | +2 |

Fig. 23 B

| SET NUMBER | PROBABILITY | PAYOUT | PAYOUT RATE |
|---|---|---|---|
| 1 | D1000 | E1000 | F10 |
| 2 | D1100 | E1100 | F11 |
| 3 | D1200 | E1200 | F12 |
| 4 | D1300 | E1300 | F13 |
| 5 | D1400 | E1400 | F14 |
| 6 | D1500 | E1500 | F15 |
| 7 | D1600 | E1600 | F16 |
| 8 | D1700 | E1700 | F17 |
| 9 | D1800 | E1800 | F18 |
| 10 | D1900 | E1900 | F19 |

GAMING MACHINE, SERVER, AND PROGRAM

CROSS-REFERENCE TO RELATED APPLICATIONS

This application is based upon and claims the benefit of priority from the prior Japanese Patent Application No. 2002-304951 filed on Oct. 18, 2002, the entire contents of which are incorporated herein by reference.

FIELD OF THE INVENTION

The present invention relates to a gaming machine, a server, and a program.

RELATED ART

A player generally plays a game with a gaming machine by inserting a game medium such as a game ball, a medal, or the like into the gaming machine, and a certain amount of game media corresponding to the game result by the player are paid out for return to the game player.

There are various game players who have various game motives. For example, some game players have game motives to mainly enjoy their games for a long time although the amount of game media to be paid out is small (hereinafter referred to as a "low-risk/low-return" motive), and some game players have game motives to mainly aim at profit-return of a large amount of media although they must take the risk (hereinafter referred to as a "high-risk/high-return" motive). Accordingly, it is preferable that the gaming machine be designed to satisfy different game motives of various game players.

In the conventional gaming machines, a big-hit shift probability such as a probability of shifting to big hit (great success, big prize winning, or jackpot), a payout such as the amount of game media to be paid out, and a payout rate such as a ratio of the amount of game media to be paid out to the amount of inserted game media are fixed by the manager or the like at an arcade. Therefore, the big-hit shift probability, the payout, and the payout rate do not vary during each game. Therefore, the game player has to play the game with the fixed big-hit shift probability, payout, and payout rate. In such game, it is hard to say that the gaming machine provides the game player with a varying sense of anticipation to the game, and thus it has been hitherto difficult to provide exquisite services to the game player. The lack of such services is caused by the restriction that the big-hit shift probability, the payout, and the payout rate cannot vary by the game player himself.

Under the foregoing circumstances, in Japanese unexamined patent application publication No. 2001-347042, there is proposed a gaming machine with which plural specification values of the big-hit shift probability and the payout can be varied by the game player himself.

Such gaming machine enables the game player to vary the big-hit shift probability and the payout, however, the gaming machine cannot amuse the game player more than the ordinal gaming machine unless some discernible effect is provided such that the game player actually makes a big hit or the like. This is because the game player could not feel a benefit or fun caused by changes in the specification values if the game player does not play the game under a game condition that a setting-variation effect discernibly appears. Accordingly, it is desirable to provide a gaming machine with which the specification values are changed by each game player in an enjoyable manner.

SUMMARY OF THE INVENTION

In view of the foregoing situation, according to the present invention, it is an object to provide a gaming machine with at least one specification value based on the total result obtained by totalizing a game result achieved by a first gaming machine and a game result achieved by a second gaming machine.

In view of the above object, the present invention provides the following.

(1) There is provided a first gaming machine for transmitting/receiving data to/from a server, comprising: specification value setting means for setting at least one specification value as a control condition for game control; transmitting means for transmitting data of a game result to the server; gaming machine determining means for determining a second gaming machine; total result data receiving means for receiving from the server data of a total game result achieved by the first gaming machine and the second gaming machine based on the data of the game result transmitted by the transmitting means; specification value determining means for determining the specification value based on the data of the total game result received by the total result data receiving means; and specification value renewing means for renewing the specification value set by the specification value setting means to the specification value determined by the specification value determining means.

(2) The first gaming machine according to (1) is characterized in that the gaming machine determining means determines a plurality of gaming machines including the second gaming machine.

(3) The first gaming machine according to (2) is characterized in that the total result data receiving means receives from the server the data of the total game result and that the total game result is achieved by the plurality of gaming machines including the first and second gaming machines.

According to the invention recited in (1), (2), or (3), a game result achieved by a game player and a game result achieved by another game player are totalized and the specification value is changed in accordance with the total result. Therefore, the specification value may be improved even if the game result of the game player is bad since the game result of the another game player could be good. Accordingly, even if the game result of the game player is not good, the game player may have a sense of anticipation for the game. Furthermore, even if the game result of the game player is good, the specification value may be depreciated since the game result of the another game player could be bad. In order to avoid such a situation, the game players try to make their game results good. Accordingly, exciting gaming machines which give the game players incentive to play the game can be provided.

(4) There is provided a first gaming machine for transmitting/receiving data to/from a second gaming machine, comprising: specification value setting means for setting at least one specification value as a control condition for game control; gaming machine determining means for determining the second gaming machine; receiving means for receiving from the second gaming machine data of a game result achieved by the second gaming machine; game result totalizing means for totalizing a game result achieved by the first gaming machine and the game result achieved by the second gaming machine based on the data of the game result of the second gaming machine received by the receiving means so as to calculate a total result; specification value determining means for determining the specification value based on the total result calculated by the game result totalizing means; and specification value renewing means for renewing the specification value set by the specification value setting means to the specification value determined by the specification value determining means.

(5) The first gaming machine according to (4) is characterized in that the gaming machine determining means determines a plurality of gaming machines including the second gaming machine and that the first gaming machine transmits and receives data to and from the plurality of gaming machines.

(6) The first gaming machine according to (5) is characterized in that the receiving means receives data of game results achieved by the plurality of gaming machines including the second gaming machine and that the game result totalizing means totalizes a game result achieved by the first gaming machine and the game results achieved by the plurality of gaming machines including the second gaming machines based on the data of the game results of the plurality of gaming machines received by the receiving means so as to calculate the total result.

According to the invention of (4), (5), or (6), a game result of a game player and a game result of another game player are totalized, and the specification value is changed in accordance with the total result. Therefore, the specification value may be improved even if the game result of the game player is bad, since the game result of the another game player is good. Accordingly, even if the game result of the game player is not good, the game player can have a sense of anticipation to the game. Furthermore, even if the game result of the game player is good, the specification value may be depreciated because the game result of the another game player is bad. In order to avoid such situation, the game players try to make their game results good. Accordingly, exciting gaming machines which give the game players incentive to play the game can be provided.

(7) The first gaming machine according to (1) further comprises gaming machine selecting means for selecting the second gaming machine based on an operation by a game player, wherein the gaming machine determining means determines the second gaming machine based on a selection result by the gaming machine selecting means.

A game player himself may wish to select a partner of which game result should be totalized with that of the game player. For example, a game player wishes to totalize his game result with a game result of his friend or a stronger game player to improve his specification value.

According to the invention recited in (7), the game player himself can select a partner of which game result are totalized with that of the game player. Accordingly, the game player can get what he wishes, and a more amusing game can be provided to the game player. Furthermore, according to the present invention, a game player can pretend a good player who may achieve a good game result in spite of the opposite fact so that the another game player selects the game player expecting to improve the specification value. As a result, exciting and thrilling games can be provided.

(8) There is provided a server for transmitting/receiving data to/from a first gaming machine and a second gaming machine, comprising: specification value setting means for setting at least one specification value as a control condition for game control with the first gaming machine; game result data receiving means for receiving data of a game result transmitted from the first gaming machine and data of a game result transmitted from the second gaming machine; game result totalizing means for totalizing the game result of the first gaming machine and the game result of the second gaming machine on the basis of the data of the game result transmitted from the first gaming machine and the data of the game result transmitted from the second gaming machine so as to calculate a total result wherein the data of the game results are received by the game result data receiving means; specification value determining means for determining the specification value based on the total result calculated by the game result totalizing means; and determined specification value transmitting means for transmitting the specification value determined by the specification value determining means to the first gaming machine and the second gaming machine.

(9) The server according to (8) is characterized in that the server transmits and receives data to and from a plurality of gaming machines including the first and second gaming machines.

(10) The server according to (9) is characterized in that the game result data receiving means receives data of game results transmitted from the plurality of gaming machines including the first and second gaming machines.

According to the invention recited in (8), (9), or (10), a game result achieved by a game player and a game result achieved by another game player are totalized, and the total result obtained from the game results is transmitted to each gaming machine. Each gaming machine changes the setting of the specification value based on the total result. Therefore, even if the game result of a game player is bad, the specification value may be increased because the game result of the another game player is good. Accordingly, even if the game result of the game player is not good, the game player can have a sense of anticipation to the game. Furthermore, even if the game result of the game player is good, the specification value may be depreciated because the game result of the another game player could be bad. In order to avoid such situation, the game players try to make their game results good. Accordingly, exciting gaming machines which give the game players incentive to play the game well can be provided.

(11) There is provided a program for directing a computer of a first gaming machine for transmitting/receiving data to/from a server to perform: setting at least one specification value as a control condition for game control with the first gaming machine; transmitting data of a game result to the server; determining a second gaming machine; receiving from the server data of a total result totalizing the game result achieved by the first gaming machine and a game result achieved by the second gaming machine; determining the specification value based on the data of the total result; and renewing the set specification value to the determined specification value.

(12) The program according to (11) is characterized in that the computer of the first gaming machine performs determining at least one gaming machine other than the second gaming machine.

(13) The program according to (12) is characterized in that the computer of the first gaming machine performs receiving from the server data of the total result totalizing a game result achieved by the at least one gaming machine other than the second gaming as well as the game results achieved by the first and second gaming machines.

According to the invention of (11), (12), or (13), the game result of the game player and the game result of the another game player are totalized, and the specification value is changed in accordance with the total result. Accordingly, even if the game result of the game player is not good, the game player can have a sense of anticipation to the game. Furthermore, even if the game result of the game player is good, the specification value may be depreciated because the game result of the another game player could be bad. In order to avoid such situation, the game players try to make their game results good. Accordingly, exciting gaming machines which give the game players incentive to play the game well can be provided.

(14) The first gaming machine according to (1) is characterized in that the specification value comprises a big-hit shift probability, a payout, a payout rate, or a combination thereof.

(15) There is provided a method of renewing at least one specification value a first gaming machine for transmitting/receiving data to/from a server, comprising: setting a first specification value as a control condition for game control with the first gaming machine; determining a second gaming machine; performing a game; transmitting data of a game result to the server; receiving from the server data of a total result totalizing the game result achieved by the first gaming machine and a game result achieved by the second gaming machine; determining a second specification value based on the data of the total result; and renewing the specification value from the first specification value to the second specification value.

Here, "game result" refers to a result after a game is carried out. The "game result" may contain not only the number of game media which have been paid out, but a combination of symbols after rotation, a result of a sub game carried out on a display device, the number of games having been played, and so on.

Furthermore, "total result" refers to a result obtained by adding or totalizing the game results of plural game players or plural gaming machines.

Other features and advantages of the invention will be apparent from the following description taken in connection with the accompanying drawings.

BRIEF DESCRIPTION OF THE DRAWINGS

FIG. 7 is a schematic diagram of a specification value determining table of the slot machine according to the embodiment of the present invention.

FIG. 16 is a flowchart of control processing executed with the slot machine according to the embodiment of the present invention.

FIG. 23A is a table for the total result of the slot machine and the variable range of the specification value for the total result according to the embodiment of the present invention.

FIG. 23B is a table for the setting of the specification value of the slot machine such as a big-hit shift probability, a payout, and a payout rate for each setting of each slot machine according to the embodiment of the present invention.

DETAILED DESCRIPTION OF THE PREFERRED EMBODIMENTS

Figure 1:
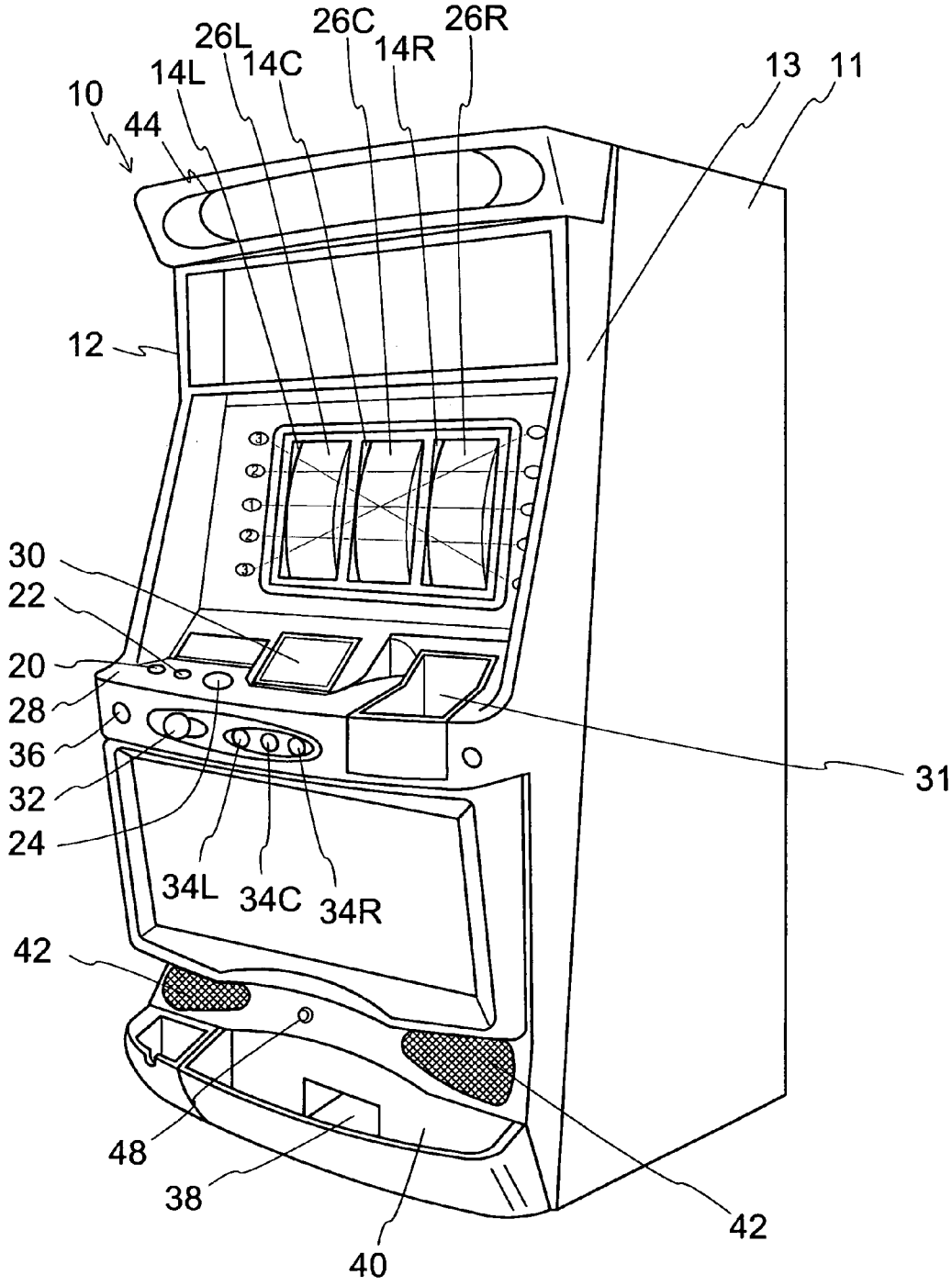
FIG. 1 is a perspective view of a slot machine according to an embodiment of the present invention.
Figure 2:
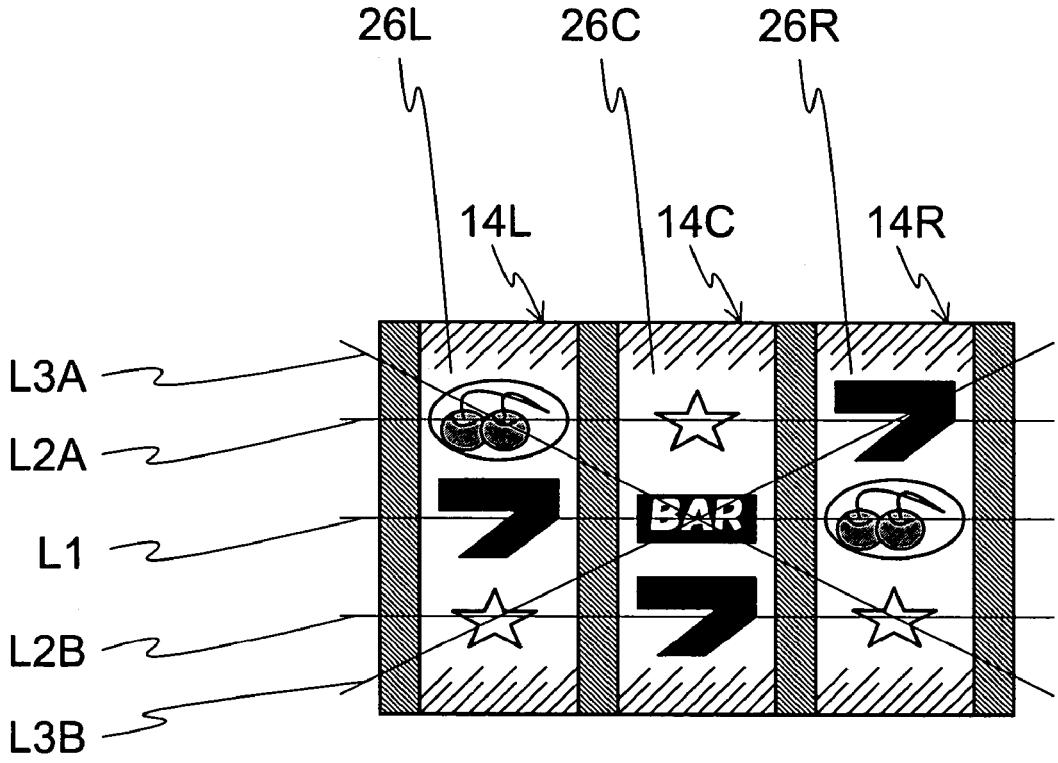
FIG. 2 is a schematic view of a part of a display screen of the slot machine according to the embodiment of the present invention.

According to the present invention, a preferred embodiment will be described hereunder referring to the drawings.

FIG. 1 is a perspective view of a gaming machine according to the embodiment of the present invention. In the following embodiment, a slot machine to which the present invention is applied will be described as a preferable embodiment of the gaming machine according to the present invention.

A housing 12 enclosing an outer periphery of a slot machine 10 comprises a main body 11 and a door 13. A rectangular display window 14 is provided on the front face of the housing 12 which forms the whole body of the slot machine 10.

Three kinds of reels 26L, 26C, 26R are freely rotatably provided in the housing 12, and plural kinds of identification information pictures (i.e., symbols) are drawn on the outer peripheral surface of each reel. Each of the reels 26L, 26C, 26R is provided so as to be visually recognized through the display window 14. The identification information pictures (i.e., symbols) drawn on the outer peripheral surfaces of the reels 26L, 26C, 26R are driven downward as the reels are rotated. When the rotation of each of the reels 26L, 26C, 26R is stopped, three identification information pictures (i.e., symbols) drawn on the outer peripheral surface of each reel are visually recognizable through the display window 14.

A display device 30 is provided at the lower side of the display window 14. The display device 30 comprises a liquid crystal display, for example. As described later, various images such as notification pictures for game contents, effect pictures for amusing game players, etc. are displayed on the display device 30.

Furthermore, a touch sensor 56 (see FIG. 4) is provided on the display device 30 to enable various kinds of operations.

A substantially horizontal seat portion 28 is provided at the lower side of the display device 30. A medal slot 31 is provided on the right side of the upper face of the seat portion 28. A medal, a token, or a coin as a game medium may be inserted into the medal slot 31 for playing the game. By way of example, the medal is used in the following description. A 1-BET switch 20 for setting only one medal out of the inserted medals as a betting target for a game by one pushing operation is provided on the left side of the upper face of the seat portion 28. In addition, a 2-BET switch 22 for setting only two medals out of the inserted medals as a betting target for the game is also provided. Furthermore, a maximum BET switch 24 for setting the permitted maximum number of medals out of the inserted medals as a betting target for the game is provided.

When the 1-BET switch 20 is operated by a game player, only a payline L1, which may be a prize-winning line, is set as a activated payline for determination of a game result (hereinafter, the activated payline will be referred to as "activated line"). When two or more medals have been already inserted and also the 2-BET switch 22 is operated by the game player, not only the payline L1, but also paylines L2A, L2B, that is, totally three paylines are set as activated lines.

Furthermore, when three or more medals have been already inserted and also the maximum BET switch 24 is operated by the game player, not only the paylines L1, L2A, L2B, but also paylines 3A, 3B, that is, totally five paylines are set as activated lines. However, when the number of residual medals out of the inserted medals is equal to two, only the three paylines L1, L2A, L2B out of the five paylines are activated. When the number of residual medals out of the inserted medals is equal to one, only the payline L1 out of the five paylines is activated. With respect to the activated paylines, an indication thereof is displayed at a side of the display window 14 and notified to the game player.

A game start allowing state is set when a game player pushes the 1-BET switch 20, the 2-BET switch 22, or the maximum BET switch 24.

As shown in FIG. 1, a start lever 32 is provided on the left side of the front face of the seat portion 28 so as to be operative by tilting. When the game player tilts the start lever 32, the three reels 26L, 26C, 26R start to rotate all at once. When the three reels 26L, 26C, 26R are rotated, the identification information pictures (i.e., symbols) drawn on the outer peripheral surface of each of the reels 26L, 26C, 26R are variably displayed.

When the rotational speeds of the three reels 26L, 26C, 26R reach a predetermined speed, the game player is allowed to operate reel stop buttons 34L, 34C, 34R as described later. However, the slot machine 10 may be configured without such stop buttons.

Three reel stop buttons 34L, 34C, 34R which can be pushed are provided at the center on the front face of the seat portion 28. The reel stop button 34L is provided to stop the reel 26L, the reel stop button 34C is provided to stop the reel 26C and the reel stop button 34R is provided to stop the reel 26R.

A payout button 36 is provided on the left side of the start lever 32. When the game player pushes the payout button 36, the inserted medals are paid out from a medal payout opening 38 at the lower portion on the front face of the housing 12. The medals thus paid out are stored in a medal tray 40.

Sound-transmissible portions 42 are provided on the upper side of the medal tray 40 to output sounds emitted from speaks (not shown) mounted in the housing 12 to the outside of the housing 12.

As described above, a predetermined number of plural kinds of identification pictures (i.e., symbols), for example, twenty one identification pictures (i.e., symbols) are drawn on the outer peripheral surface of each of the reels 26L, 26C, 26R. A predetermined number of medals are paid out and the current game condition is shifted to a more desirable game condition for the game player in accordance with the combination of identification information pictures (i.e., symbols) when each of the reels 26L, 26C, 26R is stopped.

Figure 3:
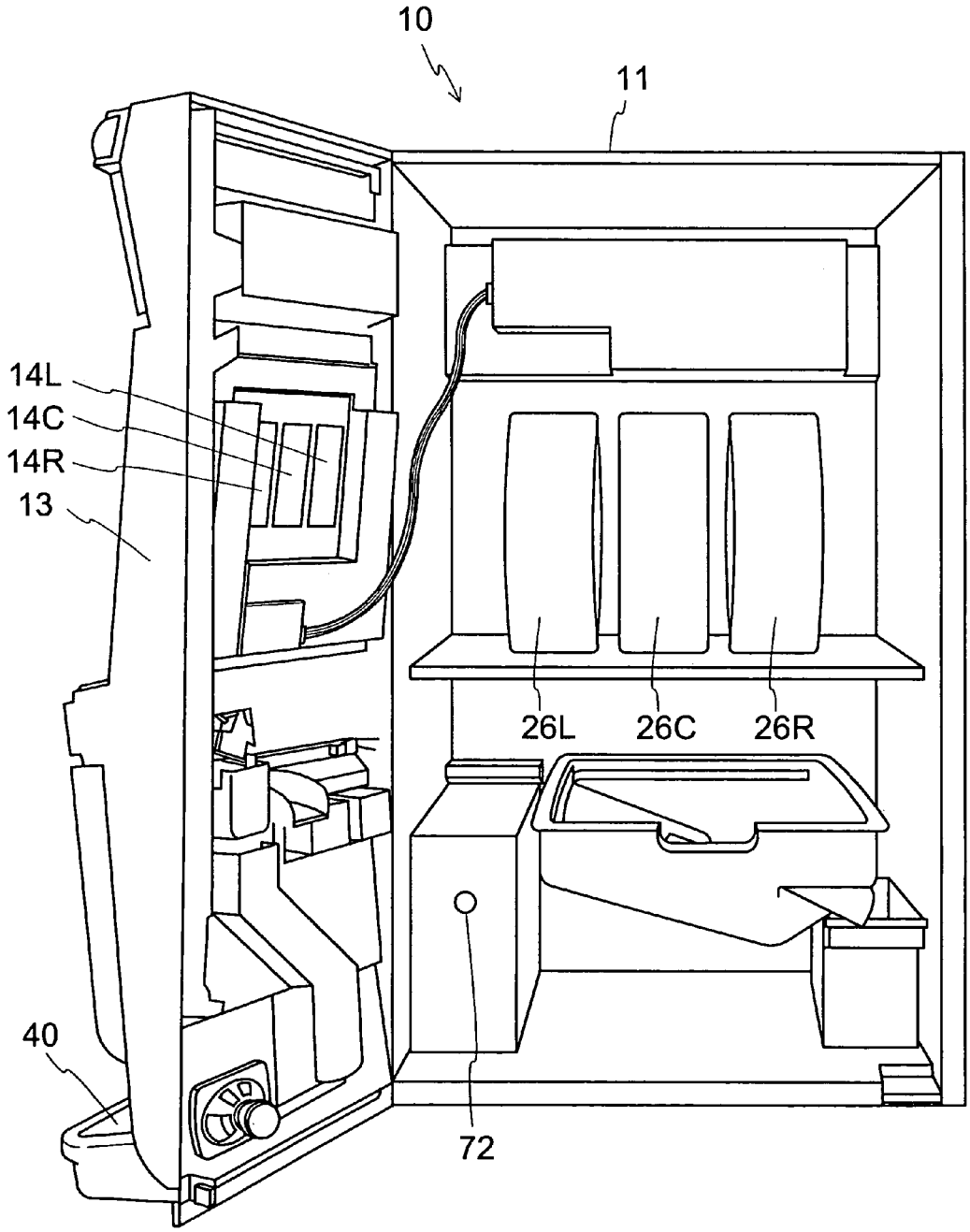
FIG. 3 is a perspective view of the slot machine according to the embodiment of the present invention.

FIG. 3 is a schematic diagram showing the internal construction of the housing of the slot machine 10 when the door 13 of the slot machine 10 is opened.

Various kinds of devices, various kinds of control boards (not shown) are contained in the slot machine 10 as shown in FIG. 3.

A setting switch 72 is provided in the housing 12, and specification values such as a big-hit shift probability, a payout, and a payout rate are set initially by the operation of a staff member of an arcade. In the gaming machine according to this embodiment, six levels can be set for each specification value. However, the slot machine according to the present invention is not limited to this particular embodiment, and any number of levels may be set for each specification value.

Figure 4:
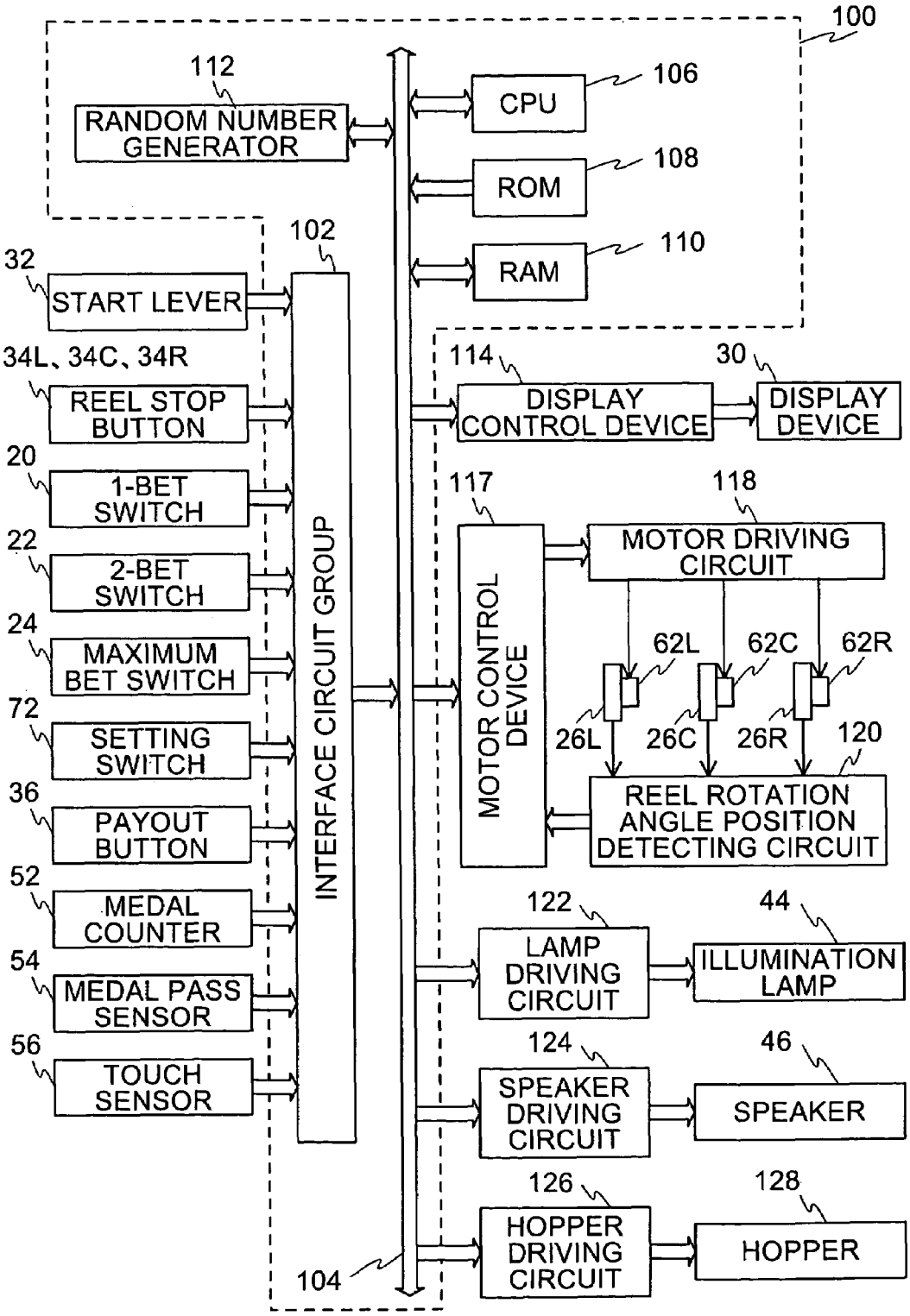
FIG. 4 is a block diagram of a circuit of the slot machine according to the embodiment of the present invention.

FIG. 4 is a block diagram showing a control circuit for the slot machine according to this embodiment.

The start level 32 described above is connected to an interface circuit group 102 of a main control circuit 100, and the interface circuit group 102 is connected to an input-output bus 104. An actuation start signal generated from the start lever 32 is converted to a predetermined signal in the interface circuit group 102, and then supplied to the input-output bus 104. The input-output bus 104 is designed so that a data signal or address signal is input/output into/from a central processing unit 106 (hereinafter referred to as "CPU") therethrough.

To the interface circuit group 102 are connected the reel stop buttons 34L, 34C, 34R, the 1-BET switch 20, the 2-BET switch 22, the maximum BET switch 24, and the payout button 36. Signals generated from these buttons and the switches are supplied to the interface circuit group 102, converted to predetermined signals, and supplied to the input-output bus 104.

Furthermore, a medal counter 52 and a medal pass sensor 54 are also connected to the interface circuit group 102. Signals generated from the counter and the sensor are also supplied to the interface circuit group 102, converted to desired signals, and then supplied to the input-output bus 104.

Furthermore, a touch sensor 56 is provided to the interface circuit group 102. By touching the display device 30, a contact signal containing the contact position or the like is supplied from the touch sensor 56.

A ROM (Read Only Memory) 108 and a RAM (Random Access Memory) 110 are connected to the input-output bus 104. The ROM 108 stores a control program for controlling the overall flow of the game of the slot machine. Furthermore, the ROM 108 also stores initial data for executing the control program, image data to be displayed on the display device 30 and audio data for sounds to be emitted from the speakers 46.

The RAM 110 temporarily stores flags and variables used for the control program.

The input-output bus 104 is provided with a random number generator 112 for generating random numbers. The random number generator 112 generates numeric values in a fixed range, for example, random numbers contained in the range from "0" to "65535" (corresponding to the value of $2^{16}$). The random number may be generated through operation processing of the CPU 106.

In the slot machine 10 of this embodiment, the random numbers are generated by the random number generator 112. However, the present invention is not limited to this mode, and the random numbers may be generated by the CPU 106 on the basis of a program stored in the ROM 108.

A communication interface circuit 74 is connected to the input-output bus 104, and thus the slot machine of this embodiment can communicate with a server 80 or the like through a communication line such as a public phone line network, a local area network (LAN), or the like.

A motor control device 117 for driving the reels 26L, 26C, 26R is connected to the input-output bus 104.

A motor driving circuit 118 is connected to the motor control device 117. Furthermore, stepping motors 62L, 62C, 62R for rotating the reels 26L, 26C, 26R respectively are connected to the motor driving circuit 118. The stepping motors 62L, 62C, 62R are provided in the three reels 26L, 26C, 26R respectively so that the rotating shafts of the stepping motors 62L, 62C, 62R serve as the rotational centers of the reels 26L, 26C, 26R, respectively.

A driving control command generated from the CPU 106 is converted to a driving signal by the motor driving circuit 118 through the motor control device 117, and the driving signal thus converted is supplied to the stepping motors 62L, 62C, 62R. The driving control command contains a command for the rotational speed, and not only the rotation control and stop control of the stepping motors 62L, 62C, 62R, but also the control of the rotational speeds thereof are performed on the basis of the driving control command.

As described above, the CPU 106 can perform the rotation control and stop control of the reels 26L, 26C, 26R and the rotational speed control thereof by controlling the stepping motors 62L, 62C, 62R.

Each of the reels 26L, 26C, 26R is provided with a rotation angle position sensor (not shown) for detecting the rotation angle position of the corresponding reel, and the rotation angle position sensors are connected to a reel rotation angle position detecting circuit 120. When a signal indicating the rotation angle position of each of the reels 26L, 26C, 26R is generated from the rotation angle position sensor, the signal is supplied to the reel rotation angle position detecting circuit 120. The signal supplied to the reel rotation angle position detecting circuit 120 is converted to a predetermined signal, and then supplied to the CPU 106 through the motor control device 117.

On the basis of the signal indicating the rotation angle position of each of the reels 26L, 26C, 26R, CPU 106 can specify identification information pictures (i.e., symbols) displayed while the game player can visually recognize the pictures (i.e., symbols) through the display window 14.

A lamp driving circuit 122 for driving an illumination lamp 44 is also connected to the input-output bus 104. The CPU 106 supplies a driving signal to the illumination lamp 44 through the lamp driving circuit 122, and turns on the illumination lamp 44 in accordance with the game condition.

Furthermore, a speaker driving circuit 124 for driving the speakers 46 is also connected to the input-output bus 104. The CPU 106 reads out audio data stored in the ROM 108, and supplies the audio data thus read to the speaker driving circuit 124. The speakers 46 supplied with the data through the speaker driving circuit 124 generates predetermined sounds.

Furthermore, a hopper driving circuit 126 for driving a hopper 128 is connected to the input-output bus 104. The CPU 106 reads out the number of medals to be paid out, and supplies a driving signal to the hopper driving circuit 126. The hopper driving circuit 126 supplied with the driving signal makes the hopper 128 pay out the medals.

Furthermore, a display control device 114 for controlling the image display operation of the display device 30 is also connected to the input-output bus 104. The display device 30 is connected to the display control device 114. The CPU 106 reads out data, etc. stored in the ROM 108, and supplies the data to the display control device 114 as described later. The display device 30 supplied with the data through the display control device 114 displays images thereon.

Figure 5:
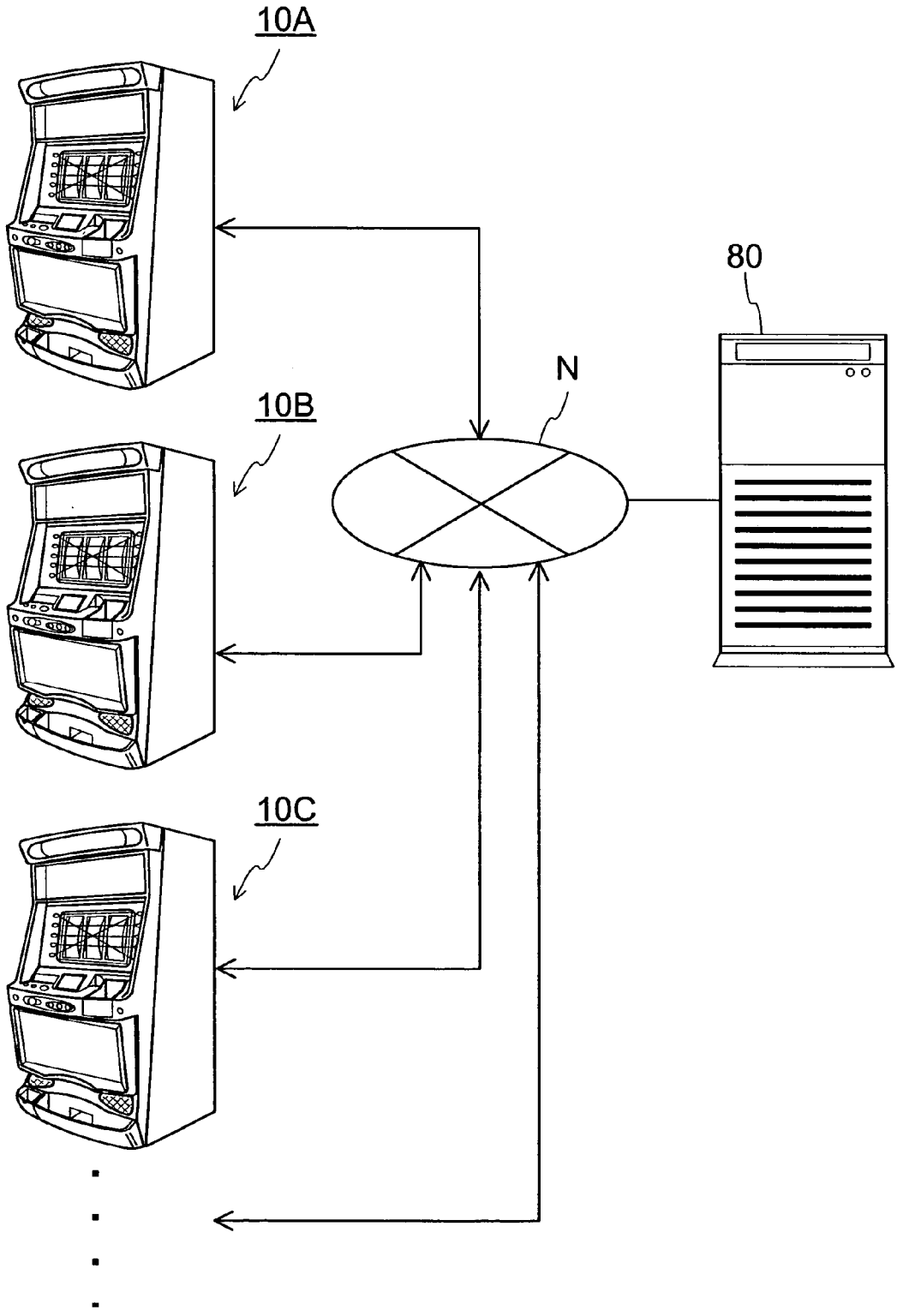
FIG. 5 is a schematic diagram of a configuration of a server and slot machines being connected to each other in a network.

FIG. 5 shows an example case where slot machines, each of which serves as a communication terminal, is connected to a server.

A plurality of slot machines 10A, 10B, 10C are connected to a server 80 through a communication line. Although the figure only has three slot machines, it should be understood that more than three slot machines may be employed in the system. The communication line may comprise a public phone line network, a cellular phone line network, a local area network (LAN), or the like.

As described later, the server 80 receives information on game conditions which are output from the slot machines 10A, 10B, 10C. The server 80 determines the setting of the signal processing in the slot machines 10A, 10B, 10C on the basis of the information concerned, and then transmits the set information to the slot machines 10A, 10B, 10C through the communication line.

As described above, the main control circuit 100 of each of the slot machines 10A, 10B, 10C as a communication terminal is provided with an input-output bus 104. Each communication interface circuit 74 is connected to the input-output bus 104. The slot machines 10A, 10B, 10C are connected to the server 80 through the communication interface circuits 74. Information such as control information, etc. is input/output between each of the slot machines 10A, 10B, 10C and the server 80.

Figure 6:
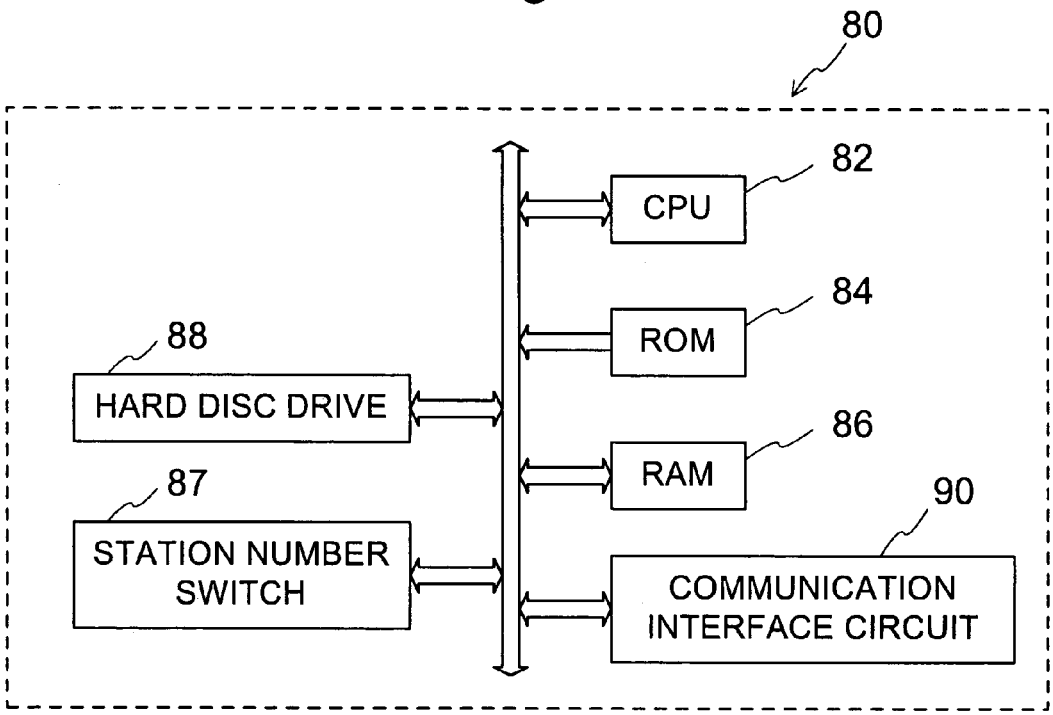
FIG. 6 is a block diagram of a circuit of the server according to the embodiment of the present invention.

FIG. 6 is a block diagram showing the circuit construction of the server 80 described above.

The server 80 comprises a hard disc drive 88, a CPU 82, a ROM 84, a RAM 86, a communication interface circuit 90, and a station number switch 87. A program, etc. described later are recorded in the hard disc drive 88. As shown in FIG. 5, the communication interface circuit 90 is connected to the slot machines 10A, 10B, 10C so that it can communicate with the slot machines 10A, 10B, 10C. The office number switch 87 sets a communication office number. The server 80 serves as a master for the slot machines 10A, 10B, 10C, and the station number switch 87 of the server 80 is set to "0000".

Transmission data between each of the slot machines 10A, 10B, 10C and the server 80 comprises a header portion and a packet portion. The header portion contains data such as the communication station number of a transmission source, the communication station number of a transmission destination, etc. The packet portion contains data such as a command code, data based on the command code, etc. For example, it is assumed that data are transmitted from a slot machine having a communication station number "0001" to the server 80 having a communication station number "0000". The communication station number of the transmission source is set to "0001", and the communication station number of the transmission destination is set to "0000". Furthermore, the command data and the data are set, and then the transmission data are transmitted. As a result, only the server 80 corresponding to the transmission destination having the communication station number "0000" receives the transmission data.

The programs recorded in the hard disc drive 88 contain a program for carrying out communication with the slot machines 10A, 10B, 10C, and a program for receiving information output from the slot machines 10A, 10B, 10C. The other programs recorded in the hard disc drive 88 contain a program for controlling the slot game, a program for totalizing the game results of plural gaming machines.

Furthermore, various kinds of tables are recorded in the hard disc drive 88 described above. The tables thus recorded contain a type code table in which type codes indicating the types of slot machines are associated with the names of the types, etc.

Furthermore, various kinds of tables are generated in the hard disc drive 88 described above. The tables thus generated contain a table number table in which communication station numbers of communication-possible slot machines are associated with the table numbers of the slot machines, etc.

When powered on, each of the slot machines 10A, 10B, 10C outputs a communication allowance request signal to the server 80 to check whether it can communicate with the server 80. The sever 80 receiving this signal first checks whether it is connected to the slot machines 10A, 10B, 10C so that the communications can be made therebetween. After this check, a communication allowance signal for notifying that the server 80 and the slot machines 10A, 10B, 10C are allowed to communicate with each other is output from the server 80 to the slot machines 10A, 10B, 10C. Each of the slot machines 10A, 10B, 10C receiving this signal supplies the table number data and the type code. The server 80 receives the table number data and generates a table.

The server 80 achieves the types of the slot machines, the table number data thereof, etc. in the manner as described above. Furthermore, the server 80 totalizes the game results of plural slot machines on the basis of the various kinds of tables described above.

In this embodiment, server-client type communications based on superordinate-subordinate management concept are carried out. However, the preset invention is not limited to this communication mode, and it should be understood that the present invention is also applied to peer-to-peer type communications based on mutually-equal management concept. That is, at least two gaming machines may be connected to each other so that they can communicate with each other.

As described above, a specification value determining table as shown in FIG. 7 is recorded in the ROM 108. The specification value determining table is a correspondence table for determining specification values containing a big-hit shift probability, a payout, and a payout rate on the basis of a result achieved by totalizing game results, that is, the total result and the setting of the setting switch 72 described above. In the specification value determining table, the specification values are shown by using various kinds of symbols and numeric values in place of actual numeric values.

The initial specification values are determined on the basis of the setting of the setting switch 72 contained in the housing 12. With respect to the column title, "1" of "PROBABILITY 1" shows that each combination of an alphabet and a numeral in each row of the column ("PROBABILITY 1") refers to the big-hit shift probability when the setting of the setting switch is set to "1". Also, "6" of "PAYOUT 6" shows each combination of an alphabet and a numeral in each row of the column ("PAYOUT 6") refers to the payout when the setting of the setting switch 72 is set to "6". In FIG. 7, "PROBABILITY" means "big-hit shift probability", and "PAYOUT" means "payout".

The game is carried out with plural gaming machines, and the specification values are renewed by referring to the total of the game results of the plural gaming machines, that is, the total result and the specification value determining table.

For example, if games are carried out with plural gaming machines and if the total result of the gaming machines is in the range from A1 to A2 and if the setting of the setting switch 72 is set to "1", the total result becomes in the range from A1 to A2 so that the specification values are renewed to the contents in the columns of "PROBABILITY 1," "PAYOUT 1," and "PAYOUT RATE 1." That is, as shown in the second row from the top row for setting 1 of FIG. 7, the probability, the payout, and the payout rate are renewed to "D1100," "E1100," and "F12".

Figure 8:
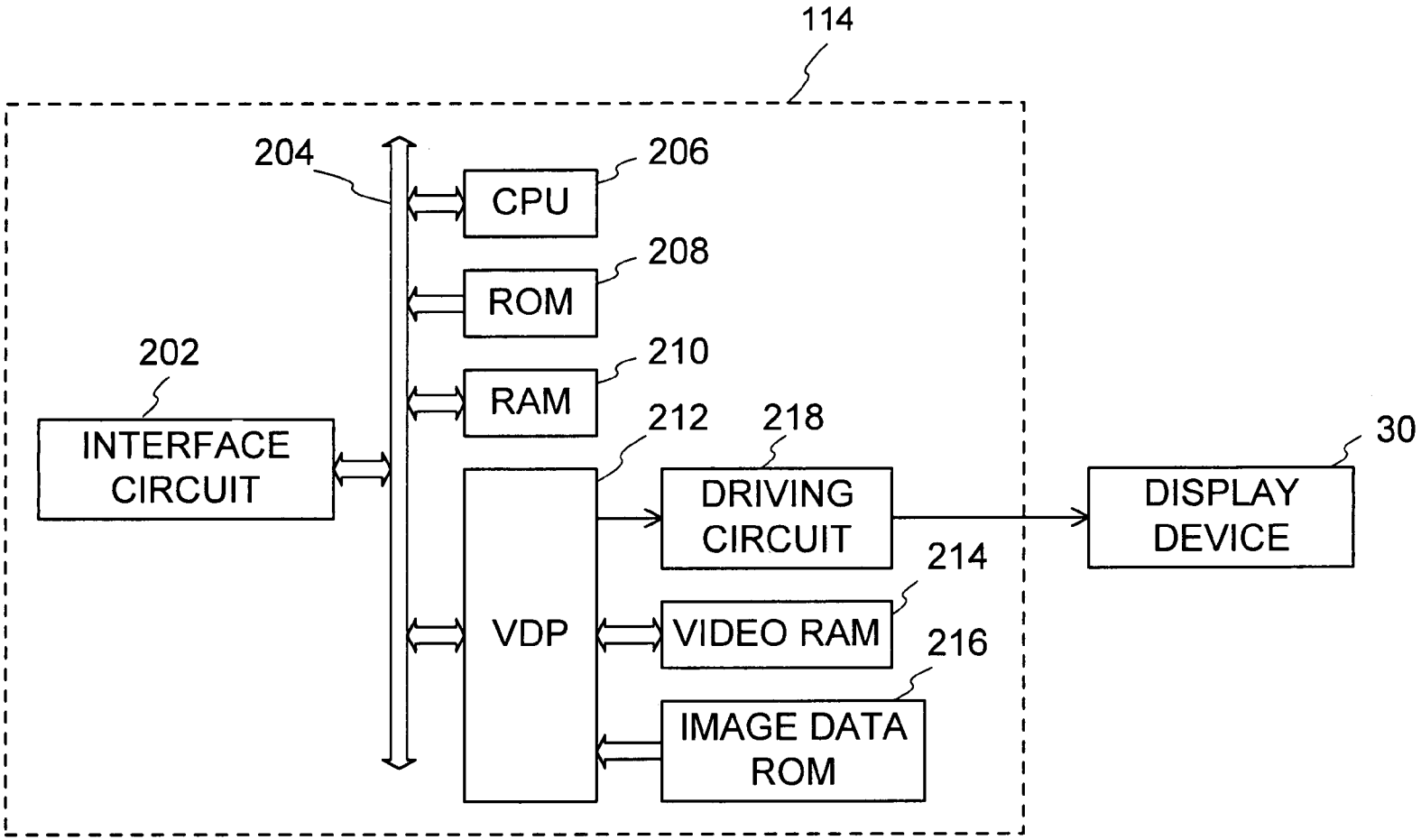
FIG. 8 is a block diagram of an electrical circuit of a display control device of the slot machine according to the embodiment of the present invention.

FIG. 8 is a block diagram showing the electrical circuit of the display control device 114 described above.

The interface circuit 202 is connected to the input-output bus 204, and an image display command output from the main control circuit 100 is supplied to the input-output bus 204 through the interface circuit 202. A data signal or address signal is input through the input-output bus 204 to a center processing circuit (hereinafter referred to as CPU) 206.

A ROM (Read Only Memory) 208 and a RAM (Random Access Memory) 210 are also connected to the input-output bus 204 described above. The ROM 208 stores a display control program for generating a driving signal to be supplied to the display device 30 on the basis of the image display command output from the main control circuit 100. The RAM 210 stores flags and variable values used for the above program.

Furthermore, an image data processor (hereinafter referred to as VDP) 212 is also connected to the input-output bus 204. The VDP 212 contains various circuits such as a so-called sprite circuit, a screen circuit, a pallet circuit, etc. The VDP 212 is a processor which can execute various processing to make the display device 30 display images.

A video RAM 214 is connected to the VDP 212 described above. The video RAM 214 stores image data corresponding to the image display command output from the main control circuit 100. Furthermore, a driving circuit 218 is connected to the VDP 212. The driving circuit 218 outputs a driving signal for driving the display device 30.

The CPU 206 described above reads out the display control program stored in the ROM 208. Subsequently, the CPU 206 executes the display control program thus read out. By executing the display control program, the CPU 206 stores the image data corresponding to the image display command output from the main control circuit 100 into the RAM 214. The image display command output from the main control circuit 100 contains various display commands such as a background display command, an operation image display command, a character display command, etc.

The ROM 216 for image data stores various image data such as character image data of characters, e.g., mobiles, moving characters, etc. displayed in a visible-effect scene; background image data constituting the background of the display device 30; and so on.

The image data for operation described above contain image data for displaying images on the display device 30 in such a display mode that the images take a series of actions.

Figure 9:
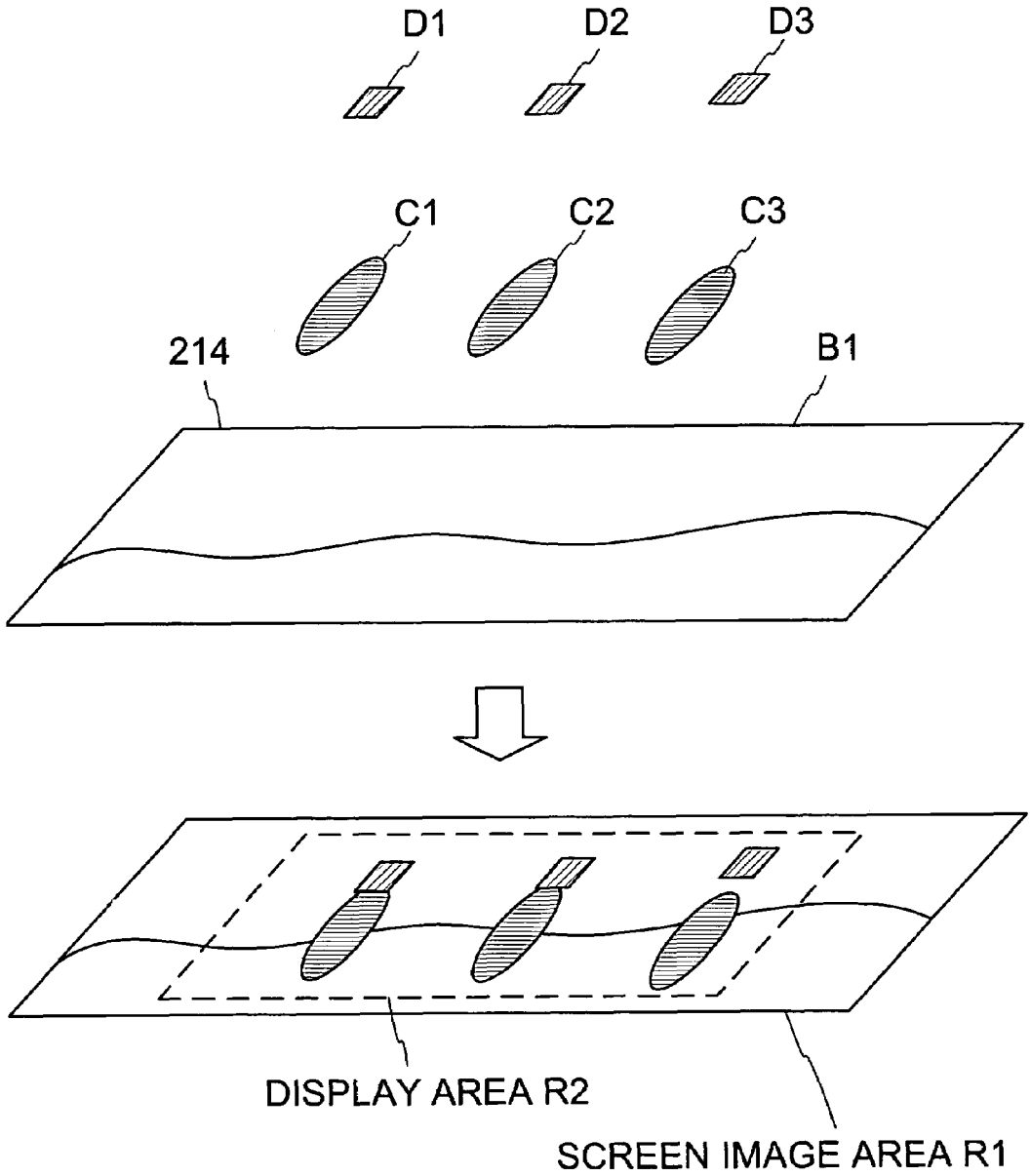
FIG. 9 is a schematic diagram of an arrangement of image data in a video RAM of the display control device according to the embodiment of the present invention.

Next, FIG. 9 is a schematic diagram showing the concept of image data generated in the video RAM 214 described above. Here, the size of the image data generated in the video RAM 214 by the screen display command will be referred to as "screen image area R1". In FIG. 9, the screen image area R1 is illustrated as an area surrounded by a solid line. The display area displayed on the display device 30 will be referred to as a display area R2. In FIG. 9, the display area R2 is illustrated as an area surrounded by a broken line.

As shown in FIG. 9, the screen image area R1 is set so as to be larger than the display area R2 displayed on the display device 30. With this setting, an image to be displayed on the display device 30 can be smoothly scrolled on the screen.

When a character display command is output from the main control circuit 100, the VDP 212 reads out each image data of character images C1 to C3 from the image data ROM 216. The image data thus read out are recorded at a prescribed area of a prescribed video RAM 214 adapted the display device 30.

Furthermore, when a background display command is output from the main control circuit 100, the VDP 212 reads out the image data of an image B1 of the background from the image data ROM 216. The image data thus read out are recorded in a prescribed area of the prescribed video RAM 214 adapted to the display device 30.

After generating image data in the video RAM 214, the VDP 212 reads out only the image data stored in the display area R2 from the video RAM 214, and supplies the image data concerned as a display signal to the driving circuit 218, whereby the images corresponding to the image data are displayed frame by frame. The images to be displayed on the display device 30 are displayed while smoothly scrolled.

Figure 10:
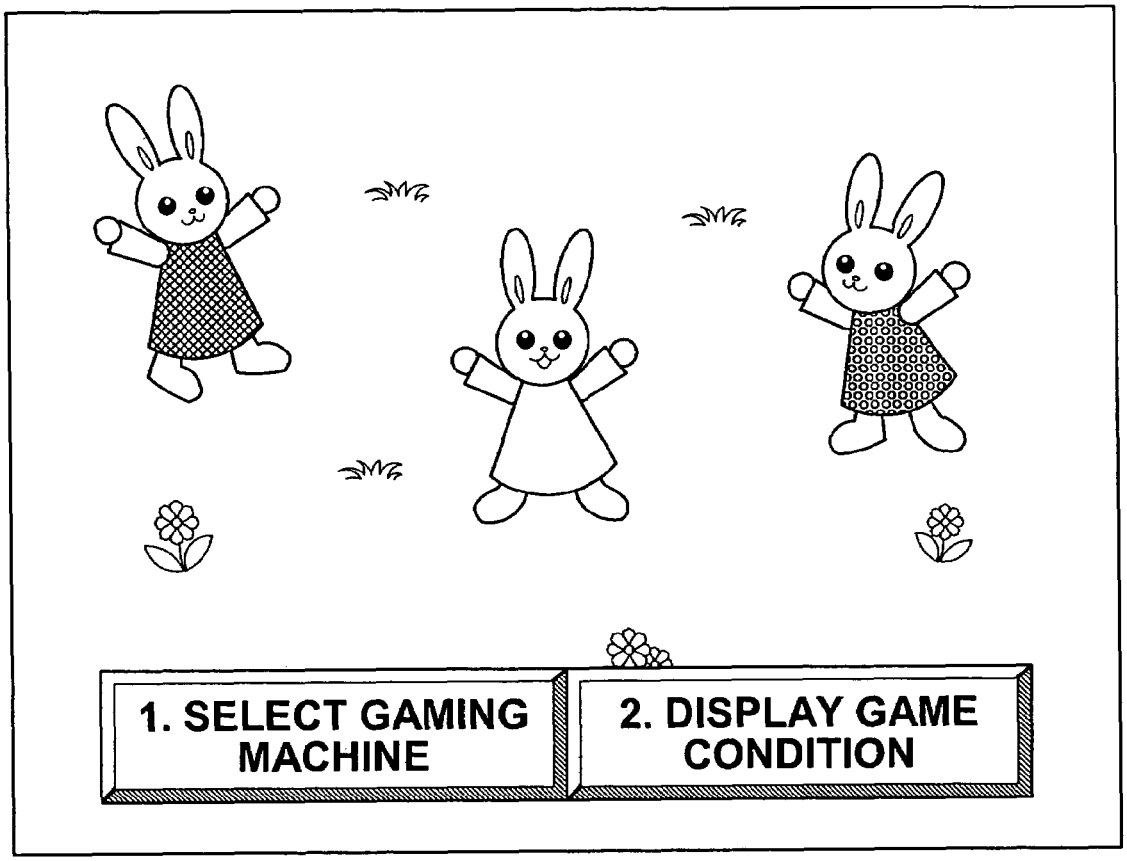
FIG. 10 is a schematic diagram of a screen display of the slot machine according to the embodiment of the present invention.

As described above, the image data are recorded on the video RAM 214, so that the images are displayed on the display device 30 and the game progresses. FIG. 10 shows a display example of images in this game.

The display device 30 is used as a sub screen of the slot game unlike each of the reels 26L, 26C, 26R.

Figure 11:
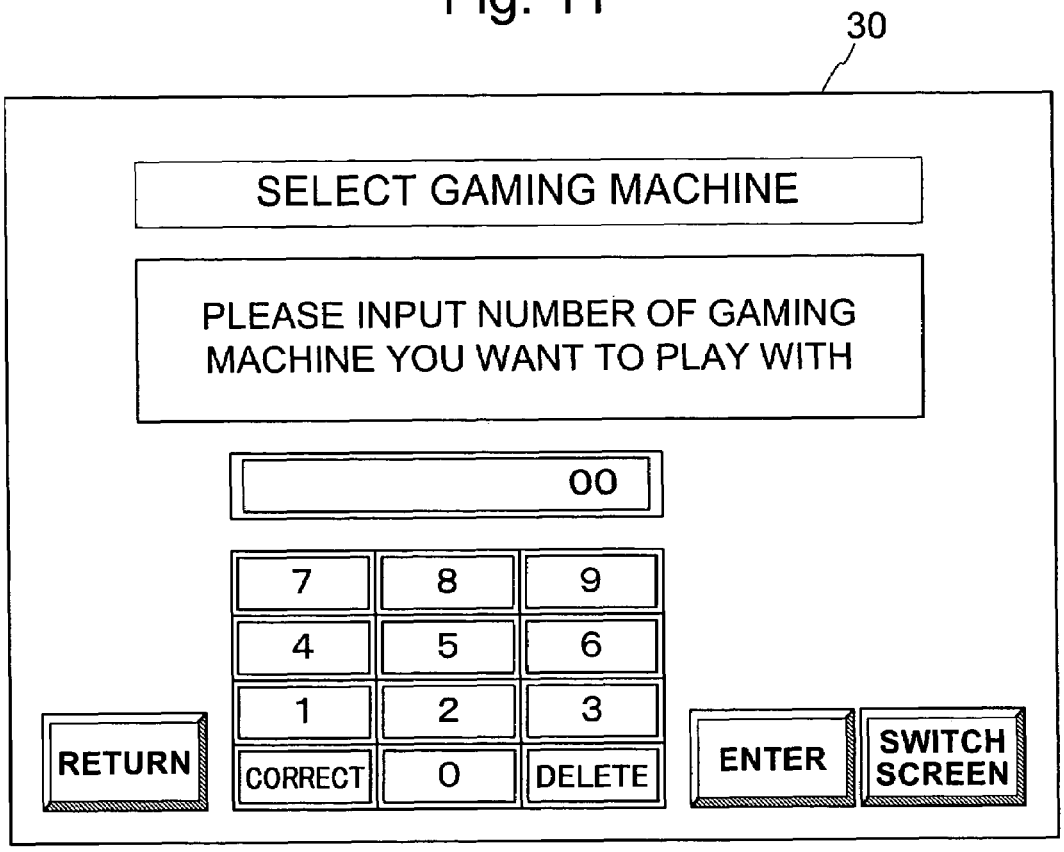
FIG. 11 is a schematic diagram of a screen display of the slot machine according to the embodiment of the present invention.
Figure 12:
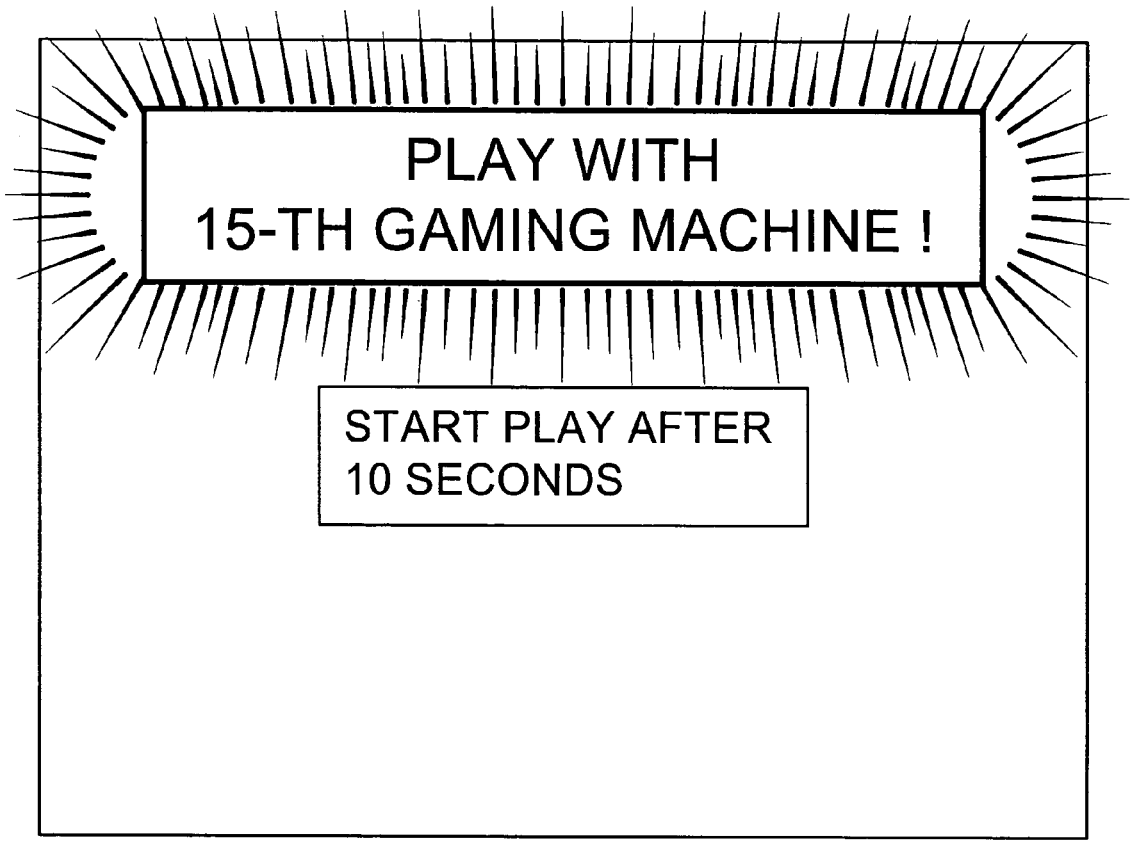
FIG. 12 is a schematic diagram of a screen display of the slot machine according to the embodiment of the present invention.

As shown in FIG. 10, two selection button images are displayed at the lower side of the display device 30. The selection button images comprise two items of "1. SELECT GAMING MACHINE" and "2. DISPLAY GAME CONDITION". When the game player touches one of the operation button images, the corresponding item is selected, and the images as shown in FIGS. 11 and 12 are displayed. In the following description, a display device of a first gaming machine operated by the game player is referred to as the display device 30A, and a display device of a second gaming machine selected by another game player is referred to as the display device 30B.

FIG. 11 is a schematic diagram showing a game machine selection image displayed on the display device 30A. FIG. 12 is a schematic diagram showing an image after selection of the gaming machine, which is displayed on the display device 30B. When "1. SELECT GAMING MACHINE" is selected in FIG. 10, the gaming machine selection image shown in FIG. 11 is displayed. As shown in FIG. 11, the gaming machine selection image contains a ten-key image and various kinds of operating button images. An image "PLEASE INPUT NUMBER OF GAMING MACHINE YOU WANT TO PLAY WITH" is displayed at the center of the gaming machine selection image.

The game player inputs the number of the gaming machine with which the player wants to play the game utilizing the ten-key image, and the number of the gaming machine thus input is displayed on the display device 30A. When the game player touches "ENTER" button, the number of the gaming machine is determined. On the other hand, when the game player touches "RETURN" button, the gaming machine selection image is returned to the selection image shown in FIG. 10.

When the game player pushes "ENTER" button, "PLAY WITH 15-TH GAMING MACHINE!" is displayed on the display device 30B of the second gaming machine thus selected as shown in FIG. 12, and the periphery of this display image is illuminated. Furthermore, "START PLAY AFTER 10 SECONDS" is displayed at the center portion of the display device 30B. After 10 seconds, the image is switched such that the play is started.

Figure 13:
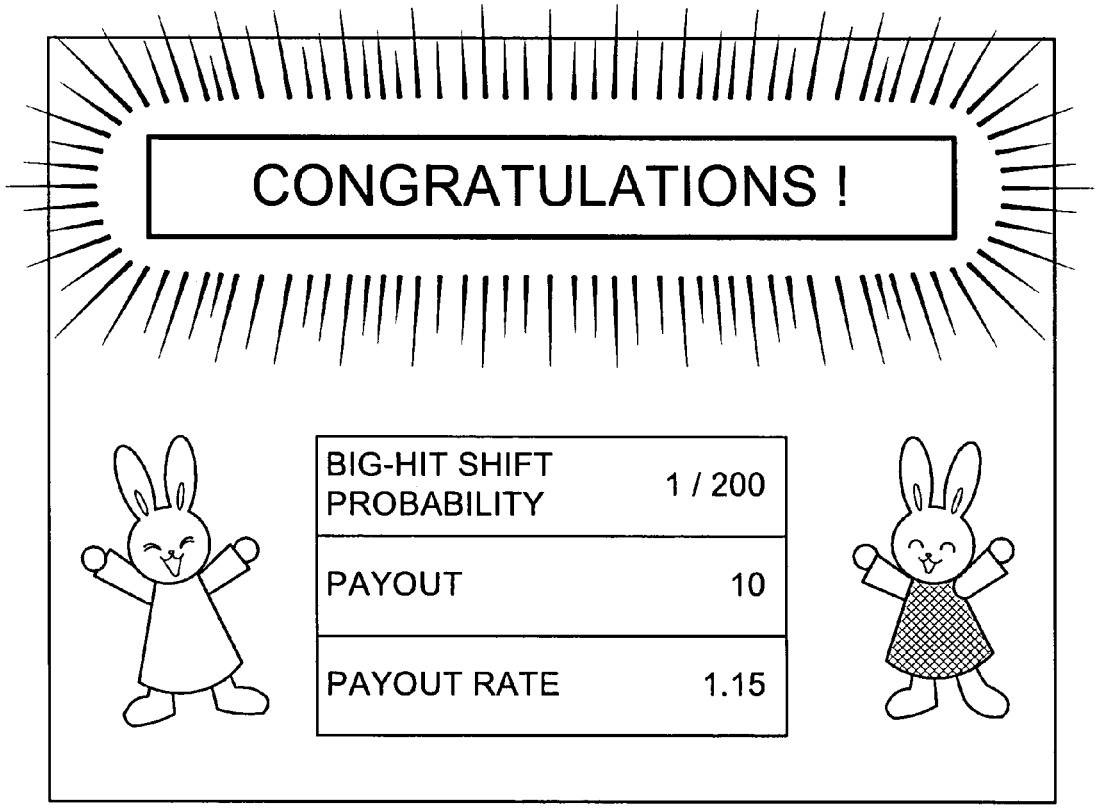
FIG. 13 is a schematic diagram of a screen display of the slot machine according to the embodiment of the present invention.
Figure 14:
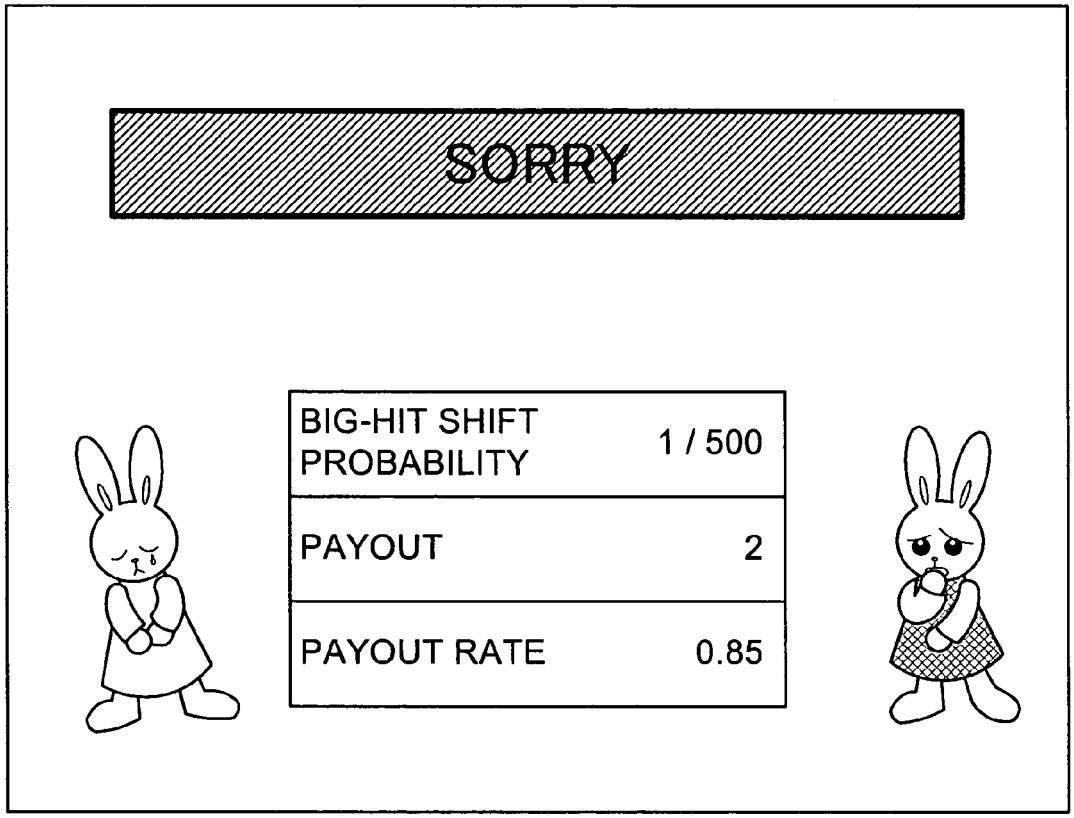
FIG. 14 is a schematic diagram of a screen display of the slot machine according to the embodiment of the present invention.

When the game is finished, an image indicating the specification values determined on the basis of the total number of payout medals for the respective gaming machines is displayed on the display device 30 as shown in FIGS. 13 and 14. When the specification values are improved, "CONGRATULATIONS !" is displayed at the upper portion of the display device 30 and the periphery thereof is illuminated as shown in FIG. 13. The big-hit shift probability, the payout, and the payout rate are displayed with characters in the area extending from the center portion to the lower portion of the display device 30. On the other hand, when the specification values are reduced, "SORRY" is displayed at the upper portion of the display device 30 and the box is darkened as shown in FIG. 14.

When the game player selects "2. DISPLAY GAME CONDITION" shown in FIG. 10, the big-hit shift probability, the payout, and the payout rate are displayed in the area extending from the center portion to the lower portion of the display device 30.

Sub routines for controlling the slot machine 10 will be described with reference to FIGS. 15 to 20. A sub routine shown in FIG. 15 is called from the actuating main program of the slot machine 10 and executed in advance.

In the following description, it is assumed that the slot machine 10 is started in advance, the variables used in the CPU 106 are initialized to predetermined values and the CPU 106 operates normally.

Figure 15:
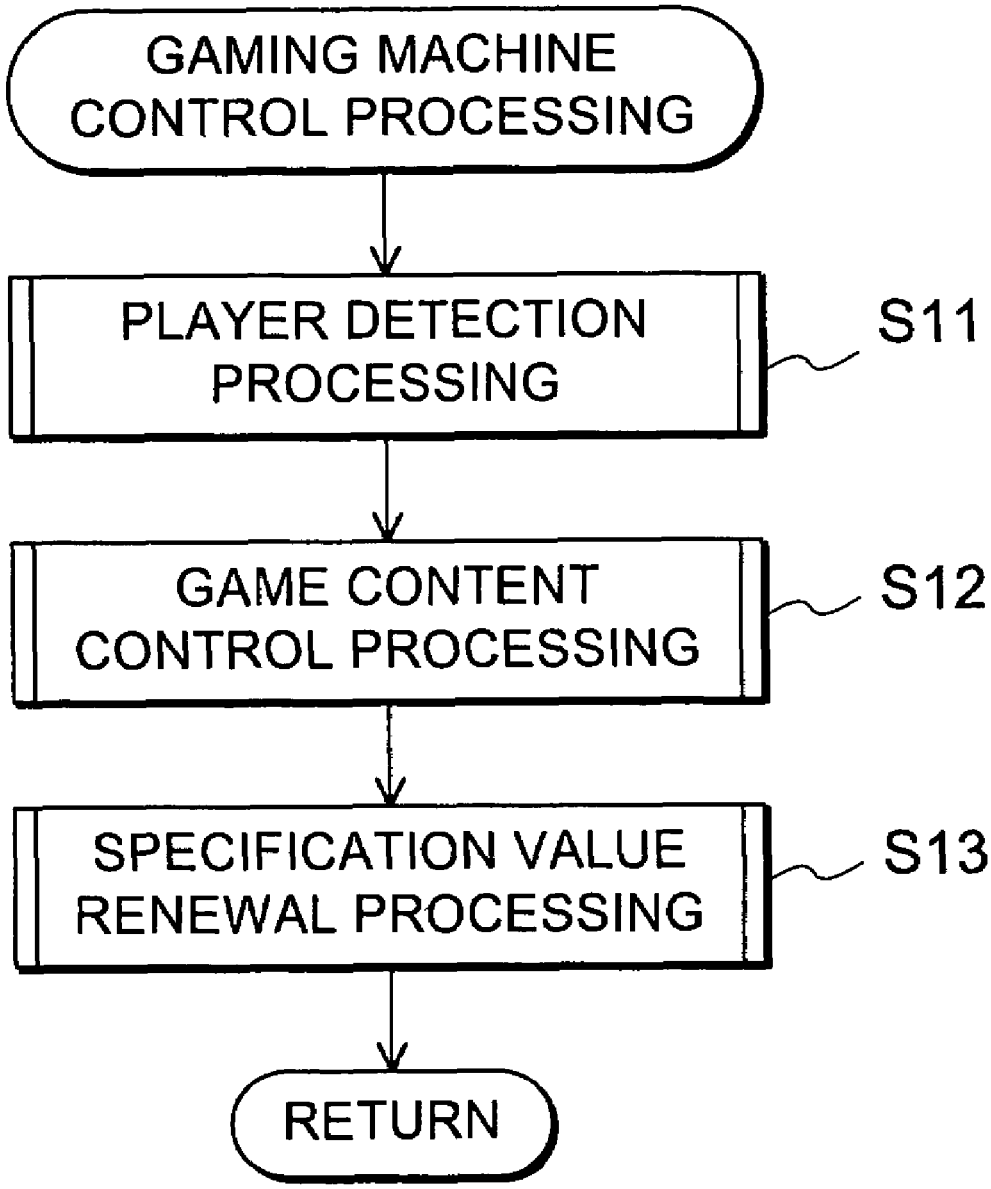
FIG. 15 is a flowchart of control processing executed with the slot machine according to the embodiment of the present invention.
Figure 17:
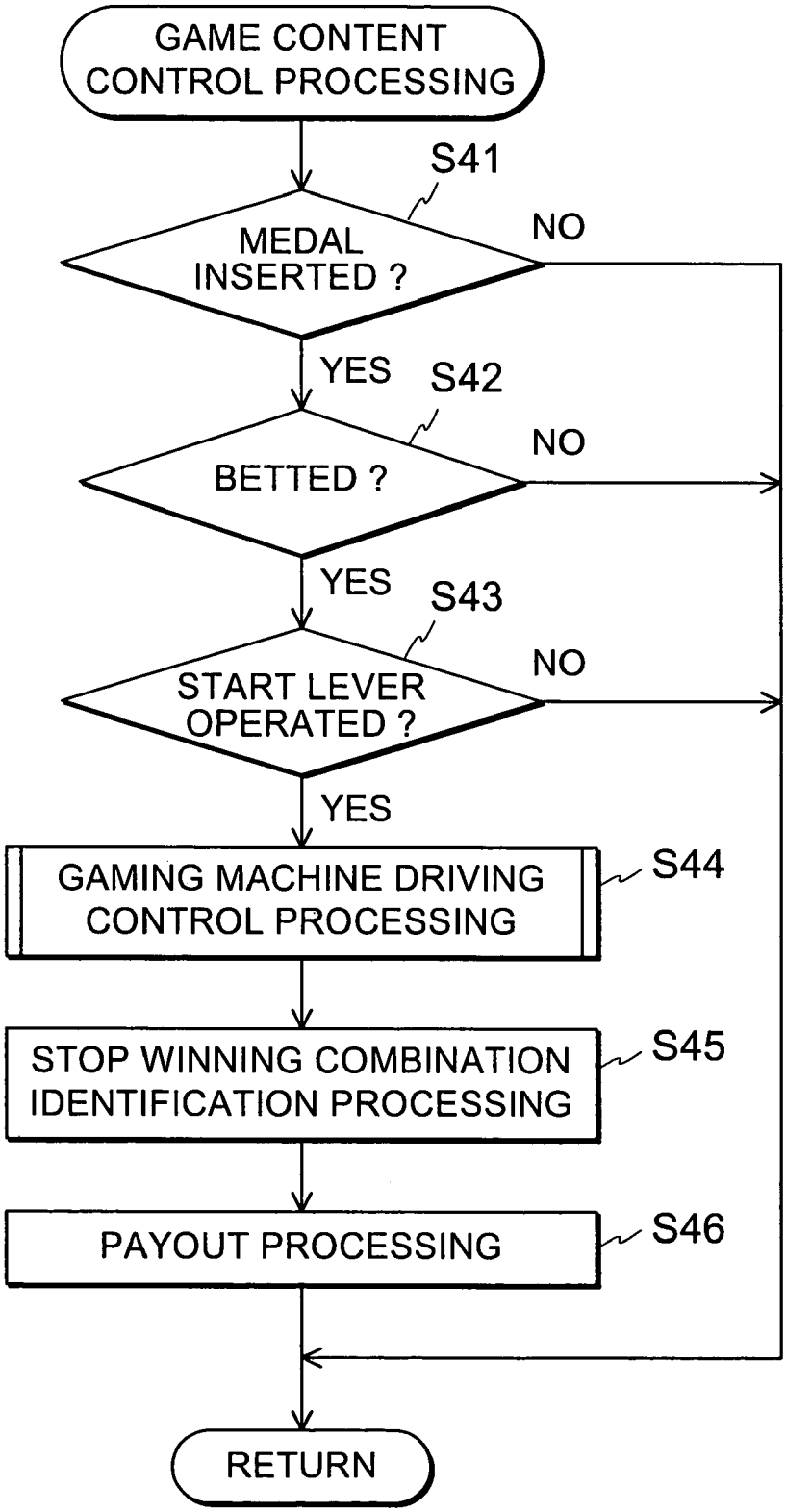
FIG. 17 is a flowchart of control processing executed with the slot machine according to the embodiment of the present invention.
Figure 18:
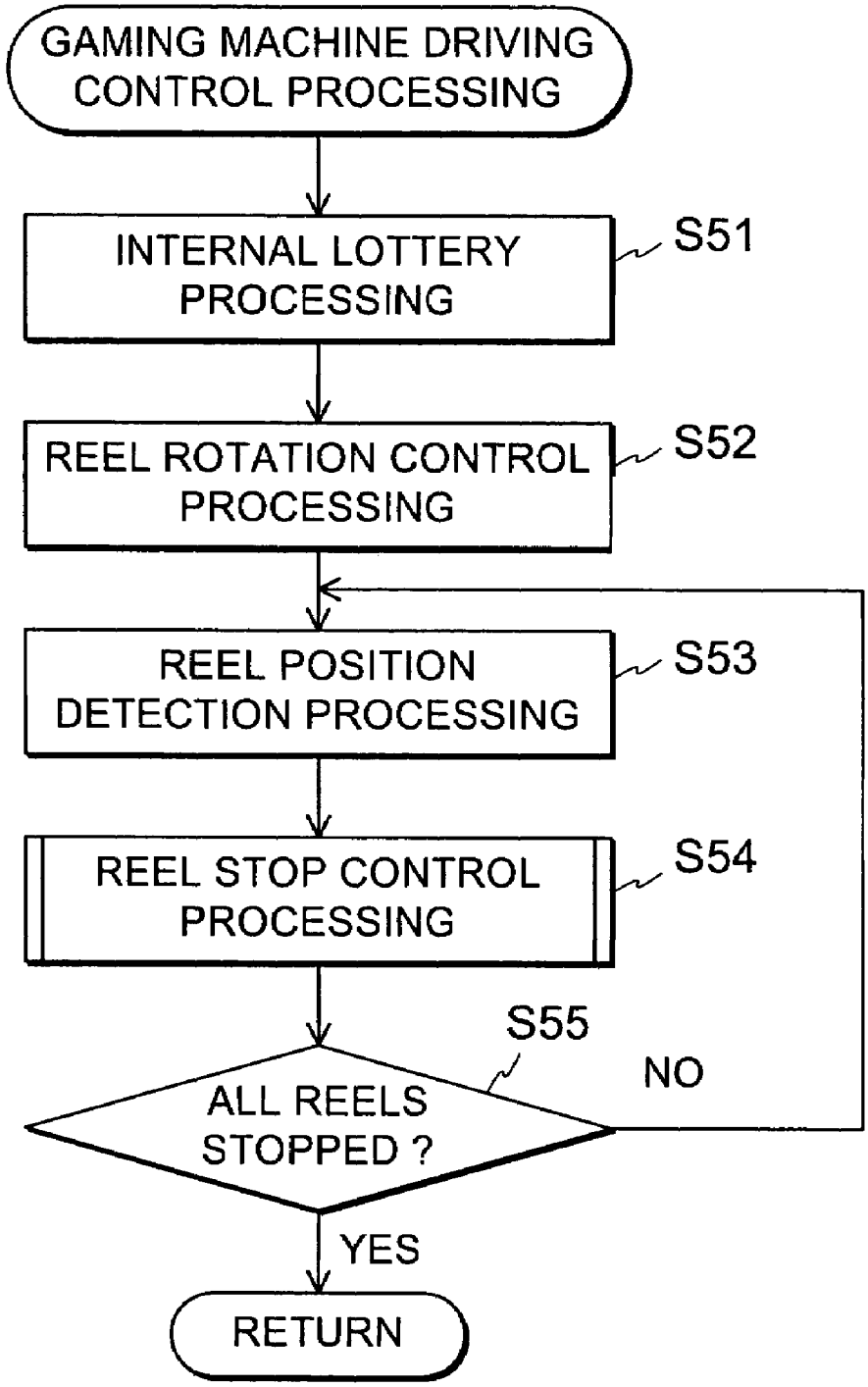
FIG. 18 is a flowchart of control processing executed with the slot machine according to the embodiment of the present invention.
Figure 19:
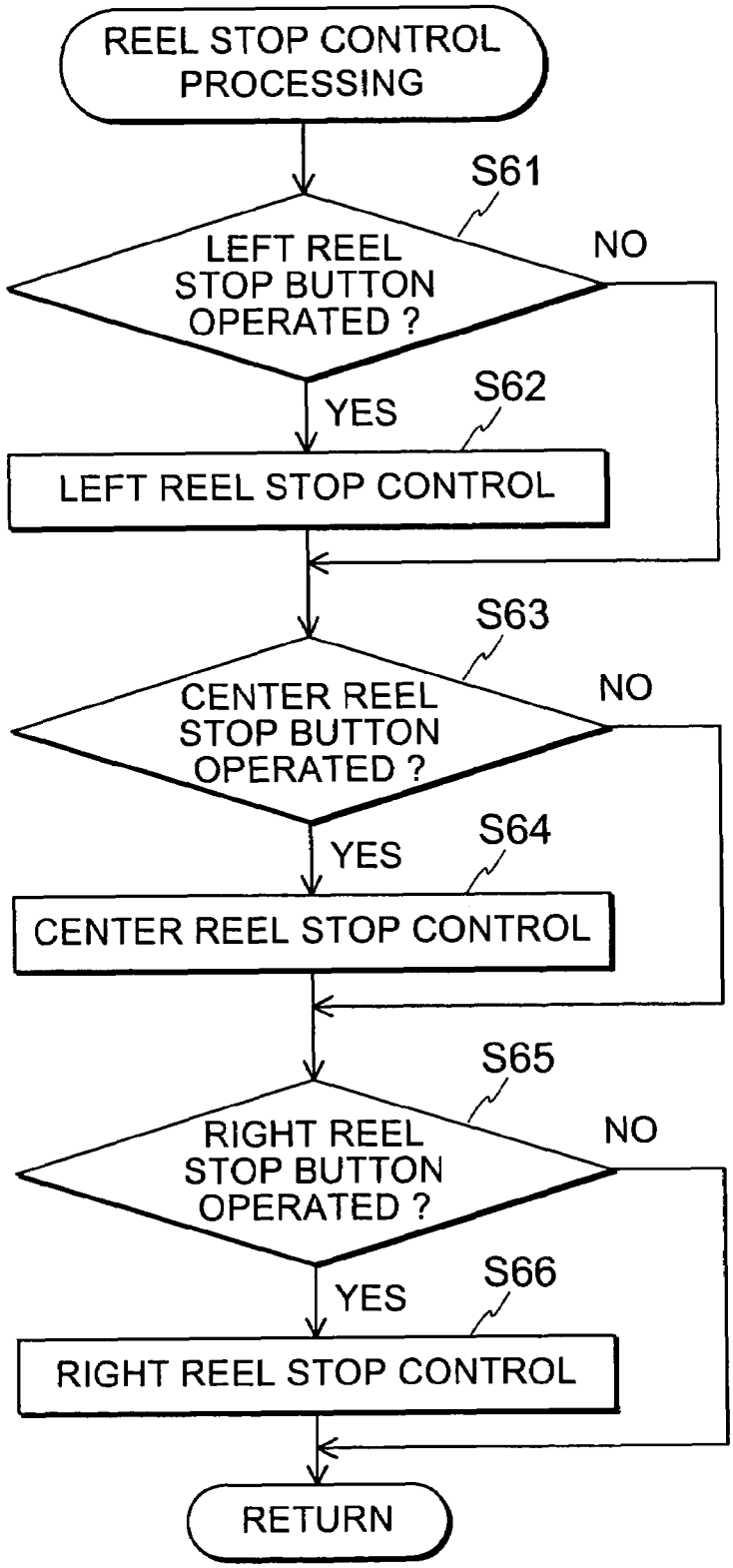
FIG. 19 is a flowchart of control processing executed with the slot machine according to the embodiment of the present invention.

First, as shown in FIG. 15, the CPU 106 executes game player detection processing (step S11). In this processing, the CPU 106 determines whether any game player exists as described later. After finishing this processing, the CPU 106 shifts the processing to step S12.

Subsequently, the CPU 106 executes game content control processing (step S12). In this processing, the CPU 106 executes the control of the game content corresponding to the main object of the game as described later. After finishing this processing, the CPU 106 shifts the processing to step S13.

Subsequently, the CPU 106 executes specification value renewal processing (step S13). In this processing, the CPU 106 renews the specification values stored in the RAM 110 on the basis of the data received from the server 80. Immediately after finishing this processing, the CPU 106 finishes this sub routine.

As described above, the processing of FIG. 16 is executed in the sub routine called in step S11.

First, the CPU 106 determines whether each of the reels 26L, 26C, 26R is varying (step S21). In this processing, the CPU 106 determines whether the CPU 106 itself supplies the driving control command to the motor control device 117. If the CPU 106 determines to supply the driving control command to the motor control device 117, the CPU 106 shifts the processing to step S22. If the CPU 106 determines that no driving control command is supplied to the motor control device 117, the CPU 106 shifts the processing to step S23.

Subsequently, the CPU 106 executes reset processing of a detection timer (step S22). In this processing, the CPU 106 resets the detection timer contained in the CPU 106. After finishing this processing, the CPU 106 shifts the processing to step S23.

Subsequently, the CPU determines whether the detection value of the detection timer is not less than a predetermined value (step S23). In this processing, if the CPU 106 determines that the detection value of the detection timer is not less than the predetermined value, the CPU 106 shifts the processing to step S25. If the CPU 106 determines that the detection value of the detection timer is not less than the predetermined value, the CPU 106 shifts the processing to step S24.

Subsequently, the CPU 106 executes game player detection flag activating processing (step S24). In this processing, the CPU 106 records as "ON" the game player detection flag positioned in the RAM 110. That is, the CPU 106 determines that a game player exists. After finishing this processing, CPU 106 shifts the processing to step S26.

In step S25, game player detection flag inactivating processing is executed. In this processing, the CPU 106 records as "OFF" the game player detection flag positioned in the RAM 110. That is, the CPU 106 determines that no game player exists. After finishing this processing, the CPU 106 shifts the processing to step S26.

Subsequently, the CPU 106 determines whether the detection flag is changed from "ON" to "OFF" (step S26). In this processing, if the CPU 106 determines that the detection flag positioned in the RAM 110 is changed from "ON" to "OFF", the CPU 106 shifts the processing to step S27. If the CPU 106 determines that the detection flag is not changed from "ON" to "OFF", CPU 106 shifts the processing to step S29.

Subsequently, specification value evacuation processing is executed by the CPU 106 (step S27). In this processing, various specification values positioned in the RAM 110 are recorded at positions different from the addresses positioned in the RAM 110 by the CPU 106 (that is, the specification values at predetermined addresses (i.e., original addresses) in the RAM 110 are recorded at addresses different from the original addresses in the RAM 110). After finishing this processing, the CPU 106 shifts the processing to step S28.

Subsequently, the CPU 106 executes specification value initialization processing (step S28). In this processing, the CPU 106 initializes various kinds of specification values. Specifically, the CPU 106 records in a predetermined area of the RAM 110 each specification value when the total result of the specification value determining table shown in FIG. 7 is "–". After the processing is finished, the CPU 106 immediately finishes this sub routine.

In step S29, the CPU 106 determines whether the detection flag is changed from "OFF" to "ON". In this processing, if the CPU 106 determined that the detection flag positioned in the RAM 110 is changed from "OFF" to "ON", the CPU 106 shifts the processing to step S30. On the other hand, if the CPU 106 determines that the detection flag is not changed from "OFF" to "ON", the CPU 106 immediately finishes this sub routine.

Figure 22:
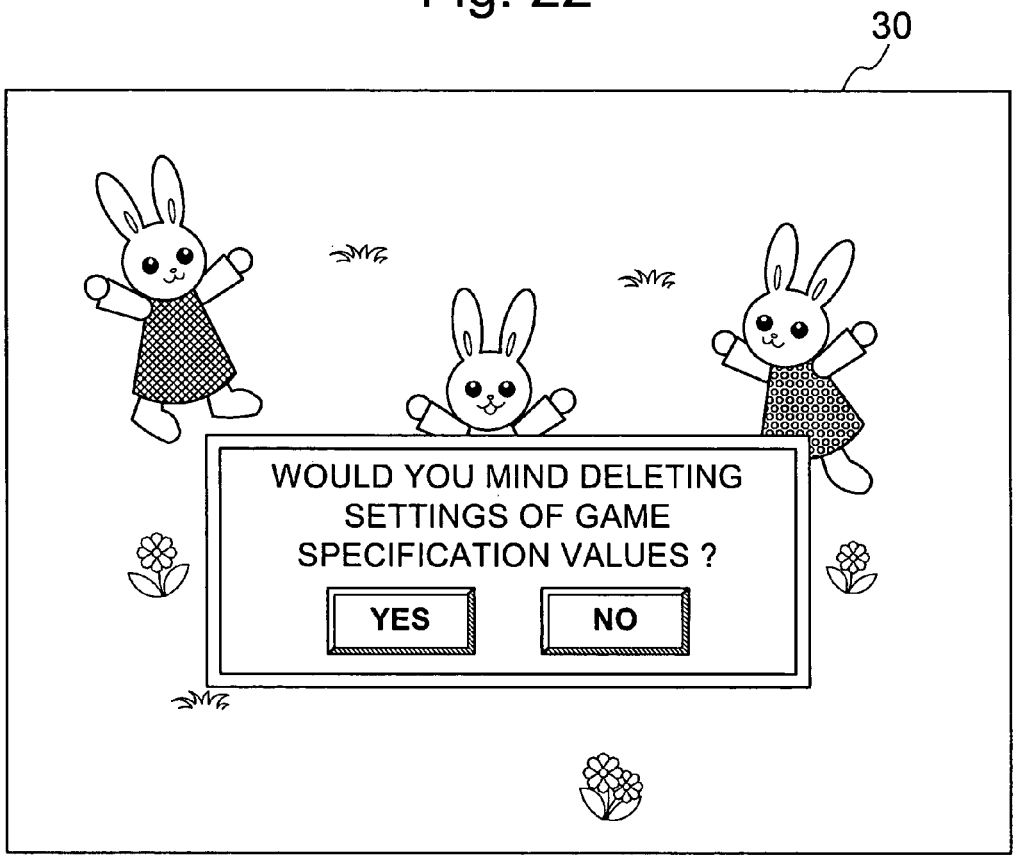
FIG. 22 is a schematic diagram of a screen display of the slot machine according to the embodiment of the present invention.

Subsequently, the CPU 106 executes notification/selection screen display processing (step S30). In this processing, the CPU 106 displays an image as shown in FIG. 22. After finishing this processing, the CPU 106 shifts the processing to step S31.

Subsequently, the CPU 106 determines whether initialization of specification values is selected or not (step S31). Here, selection of the initialization of the specification values means that the game player touches "YES" of the operation button image displayed on the screen of the display device shown in FIG. 22. Non-selection of the initialization of the specification values means that the game player touches "NO" of the operation button image displayed on the screen of the display device 30. In this processing, if the CPU 106 determines that the initialization is selected, the CPU 106 shifts the processing to step S32. If the CPU 106 determines that the initialization is not selected, the CPU 106 shifts the processing to step S33.

In step S32, the CPU 106 executes specification value setting processing. In this processing, the CPU 106 records in the RAM 110 the various specification values which have been restored in the RAM 110 through the processing of step S27, whereby the various specification values set previously can be reset. After finishing this processing, the CPU 106 finishes this sub routine.

In step S33, the CPU 106 executes restored specification value deletion processing (step S33). In this processing, the CPU 106 resets the various kinds of specifications restored in the RAM 110 through the processing of step S27, thereby keeping the initialized state. After finishing this processing, the CPU 106 finishes this sub routine.

As described above, the processing shown in FIG. 17 is carried out in game content control processing called from step S13 as described above.

First, the CPU 106 determines whether a medal is inserted or not (step S41). In this processing, if the CPU 106 determines that a medal is inserted, the CPU 106 shifts the processing to step S42. On the other hand, if the CPU 106 determines that no medal is inserted, the CPU 106 immediately finishes this sub routine.

In step S42, the CPU 106 determines whether the BET switch is operated or not. In this processing, if the CPU 106 determines that the BET switch is operated, the CPU 106 shifts the processing to step S43. On the other hand, if the CPU 106 determines that the BET switch is operated, the CPU 106 immediately finishes this sub routine. The BET switch contains the 1-BET switch 20, the 2-BET switch 22, and the maximum BET switch 24.

In step S43, the CPU 106 determines whether the start lever 32 is operated or not. In this processing, if the CPU 106 determines whether the start lever 32 is operated, the CPU 106 shifts the processing to step S44. On the other hand, if the CPU 106 determines that the start lever 32 is not operated, the CPU 106 immediately finishes this sub routine.

In step S44, the CPU 106 executes gaming machine driving control processing. In this processing, the CPU 106 executes the control for concrete contents of the game. After finishing this processing, the CPU 106 shifts the processing to step S45.

Subsequently, the CPU 106 executes stop winning-combination determination processing (step S45). In this processing, the reel rotation angle position detecting circuit 120 receives a signal representing a rotation angle position which is output from the rotation angle position sensor. The reel rotation angle position detecting circuit 120 converts the signal thus received to a predetermined signal. Furthermore, the reel rotation angle position detecting circuit 120 supplies the received signal to the CPU 106 through the bus 104. The CPU 106 receiving the signal from the reel rotation angle position detecting circuit 120 detects the rotation angle position of each of the reels 26L, 26C, 26R on the basis of the signal. Furthermore, the CPU 106 identifies a winning combination on the basis of the stop positions of the reels 26L, 26C, 26R, that is, symbols (design) stopped and displayed at the display window 14, the table representing the stop modes of the symbols for which medals are paid out, and the data indicating activated lines for which medals are betted. Furthermore, the CPU 106 records the winning-combination data indicating the identified winning-combination in the RAM 110. After finishing this processing, the CPU 106 shifts the processing to step S46.

Subsequently, the CPU 106 executes payout processing (step S46). In this processing, the CPU 106 calculates the number of medals to be paid out (hereinafter referred to as "payout number") on the basis of the kind of the winning-combination determined by the processing in step 45. The CPU 106 supplies a driving signal to the hopper driving circuit 126 on the basis of the payout number thus calculated. The hopper driving circuit 126 receiving the driving signal drives the hopper 128 to pay out medals. After finishing this processing, the CPU 106 finishes this sub routine.

As described above, the processing shown in FIG. 8 is called in the gaming machine driving control processing routine called in step S44.

First, the CPU 106 executes internal lottery processing (step S51). In this processing, the CPU 106 outputs a command to the random number generator 112 to generate a random number. Upon receiving this command, the random number generator 112 generates a random number. The CPU 106 records the internal lottery data based on the random number thus achieved at a predetermined position of the RAM 110. After finishing this processing, the CPU 106 shifts the processing to step S52.

Subsequently, the reel rotation control processing is executed (step S52). In this processing, the CPU 106 outputs a command to the motor control device 117 to rotate each of the reels 26L, 26C, 26R. Upon receiving the command, the motor control device 117 transmits to the motor driving circuit 118 a signal indicating that each of the reels 26L, 26C, 26R is rotated. With this signal, each of the stepping motors 62L, 62C, 62R is driven, and each of the three reels 26L, 26C, 26R starts to rotate. After finishing this processing, the CPU 106 shifts the processing to step S53.

Subsequently, the CPU 106 executes reel position detection processing (step S53). In this processing, the CPU 106 receives signals indicating the rotation angle positions output from the rotation angle position sensors. The reel rotation angle position detecting circuit 120 converts the signals to predetermined signals. The signals thus converted are supplied to the CPU 106 through the input-output bus 104. The CPU 106 receiving the signals described above detects the rotation angle positions of the reels 26L, 26C, 26R on the basis of these signals. After finishing this processing, the CPU 106 shifts the processing to step S54.

Subsequently, the CPU 106 executes reel stop control processing (step S54). In this processing, the CPU 106 receives stop signals generated from the reel stop buttons 34L, 34C, 34R through the interface circuit group 102 and the input-output bus 104 as described later. The stop signal is generated when the game player pushes each of the reel stop buttons 34L, 34C, 34R. The CPU 106 receiving each stop signal transmits a stop control signal to the motor control device 117 through the input-output bus 104 to stop the reel 26L, 26C, 26R corresponding to the reel stop button 34L, 34C, 34R thus pushed. The motor control device 117 receiving the signal transmits a driving signal to the stepping motor 62L, 62C, 62R. Each stepping motor 62L, 62C, 62R receiving the corresponding stop signal controls the rotation and stop of the corresponding reel 26L, 26C, 26R and also the controls the rotational speed thereof, whereby symbols drawn on the peripheral surface of each of the reels 26L, 26C, 26R are stopped and displayed. The reels 26L, 26C, 26R are stopped at the positions calculated through the internal lottery processing of step S51. After finishing this processing, the CPU 106 shifts the processing to step S55.

Subsequently, the CPU 106 determines whether all the reels are stopped or not (step S55). In this processing, if the CPU 106 determines that all the reels are stopped, the CPU 106 finishes this sub routine. If the CPU 106 determines that al the reels are not stopped, the CPU 106 shifts the processing to step S53. Specifically, on the basis of the signal indicating the rotation angle position detected through the processing of step S53, the CPU 106 determines whether the stepping motor 62L, 62C, 62R is stopped. If the CPU 106 determines that the stepping motors 62L, 62C, 62R are stopped, the CPU 106 finishes this sub routine. If the CPU 106 determines that all the stepping motors 62L, 62C, 62R are not stopped, the CPU 106 shifts the processing to step S53.

As described above, the processing shown in FIG. 19 is carried out in the reel stop control processing routine called in step S54.

First, the CPU 106 determines whether the left reel stop button 34L is operated (step S61). In this processing, if the CPU 106 determines that the left reel stop button 34L is operated, the CPU 106 shifts the processing to step S62. If the CPU 106 determines that the left reel stop button 34L is not operated, the CPU 106 shifts the processing to step S63.

Specifically, when the CPU 106 determines that it receives a signal supplied through the operation of the left reel stop button 34L, the CPU 106 shifts the processing to step S62. If the CPU 106 determines that it does not receive the signal supplied through the operation of the left reel stop button 34L, the CPU 106 shifts the processing to step S63.

In step S62, the CPU 106 executes left reel stop processing. In this processing, the CPU 106 transmits a stop signal to the motor control device 117. The CPU 106 stops the stepping motor 62L through the motor driving circuit 118 to stop the left reel 26L. The stepping motor 62L is stopped on the basis of internal lottery data generated through the processing of step S51 and the signal representing the rotation angle position detected through the processing of the step S53. If this processing is finished, the CPU 106 shifts the processing to step S63.

In step S63, the CPU 106 determines whether the center reel stop button 34C is operated or not. In this processing, if the CPU 106 determines that the center reel stop button 34C is operated, the CPU 106 shifts the processing to step S64. If the CPU 106 determines that the center reel stop button 34C is not operated, the CPU 106 shifts the processing to step S65.

Specifically, if the CPU 106 determines that it receives a signal supplied through the operation of the center reel stop button 34C, the CPU 106 shifts the processing to step S64. If the CPU 106 determines that it does not receive the signal supplied through the operation of the center reel stop button 34C, the CPU shifts the processing to step S65.

In step S64, the CPU 106 executes center reel stop processing. In this processing, the CPU 106 transmits a stop signal to the motor control device 117. The CPU 106 stops the stepping motor 62C through the motor driving circuit 118 to stop the center reel 26C. At this time, the stepping motor 62C is stopped on the basis of the internal lottery data generated through the processing of step S51 and the rotation angle position detected through the step S53. If this processing is finished, the CPU 106 shifts the processing to step S65.

In step 65, the CPU 106 determines whether the right reel stop button 34R is operated or not. In this processing, if the CPU 106 determines that the right reel stop button 34R is operated, the CPU 106 shifts the processing to step S66. If the CPU 106 determines that the right reel stop button 34R is not operated, the CPU 106 finishes this sub routine.

Specifically, if the CPU 106 determines that it receives the signal supplied through the right reel stop button 34R, the CPU 106 shifts the processing to step S66. On the other hand, if the CPU 106 determines that it does not receive the signal supplied through the operation of the right reel stop button 34R, the CPU 106 finishes this sub routine.

In step S66, the CPU 106 executes the right reel stop processing. In this processing, the CPU 106 transmits a stop signal to the motor control device 117. The CPU 106 stops the stepping motor 62R through the motor driving circuit 118 to stop the right reel 26R. At this time, the stepping motor 62R is stopped on the basis of the internal lottery data generated through the processing of step S51 and the signal indicating the rotation angle position detected through the processing of the step S53. If this processing is finished, the CPU 106 finishes this sub routine.

Figure 20:
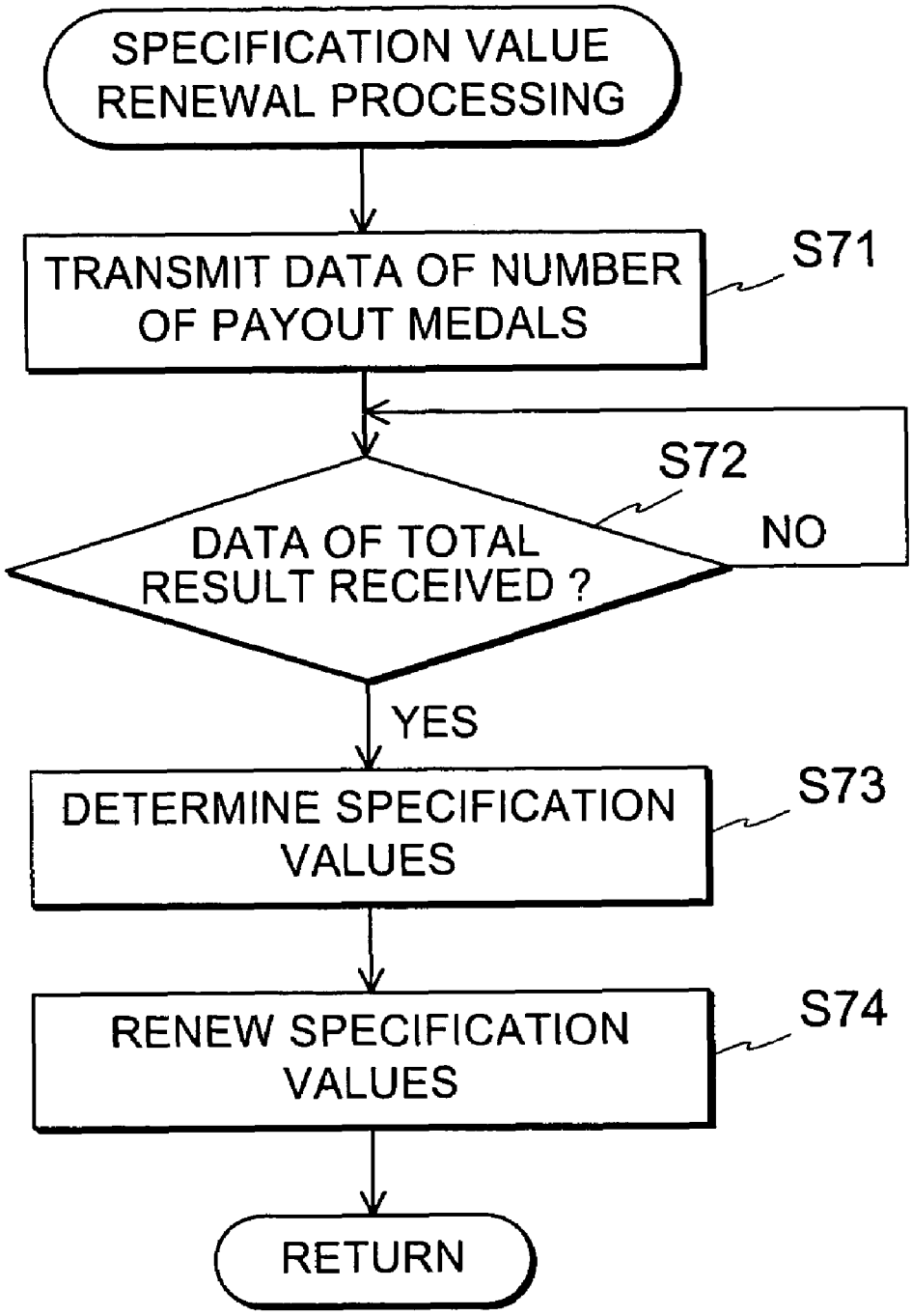
FIG. 20 is a flowchart of control processing executed with the slot machine according to the embodiment of the present invention.

The processing shown in FIG. 20 is carried out in the specification value renewal processing routine called in step S13.

First, the CPU 106 transmits the data of the number of medals to be paid out (step S71). In this processing, the CPU 106 transmits the data of the number of medals paid out through the processing of step S46, that is, the game result to the server 80 through the interface circuit group 102. After this processing is finished, the CPU 106 shifts the processing to step S72.

Subsequently, the CPU 106 determines whether it receives the data of the total result from the server 80 (step S72). As described later, the server 80 totalizes the data of the numbers of payout medals transmitted from two gaming machines to calculate a total result. The data of the total result thus calculated is transmitted to each gaming machine through the communication interface circuit 90. The CPU 106 determines whether the data of the total result is received. If the CPU 106 determines that the data of the total result is received, the CPU 106 shifts the processing to step S73. If the CPU 106 determines that the data of the total result is not received, the CPU 106 determines again whether the data of the total result is received or not.

Subsequently, the CPU 106 executes specification value determining processing (step S73). In this processing, the CPU 106 refers to the specification value determining table recorded in the ROM 108 on the basis of the data of the total result received through the processing of step S72 to determine the big-hit shift probability, the payout, and the payout rate. When this processing is finished, the CPU 106 shifts the processing to step S74.

Subsequently, the CPU 106 executes the specification value renewal processing (step S74). In this processing, the CPU 106 renews the respective data of the big-hit shift probability, the payout and the payout rate stored in the RAM 110 to the respective data of the big-hit shift probability, the payout, and the payout rate determined through the processing of the step S73, and stores the data thus renewed into the RAM 110. Specifically, if the total of the numbers of payout medals is not less than a predetermined fixed number, the big-hit probability, the payout and the payout rate are increased. On the other hand, if the total of the numbers of payout medals is less than the predetermined fixed number, the big-hit probability, the payout, and the payout rate are reduced so as to be depreciated. After finishing this processing, the CPU 106 finishes this sub routine.

Figure 21:
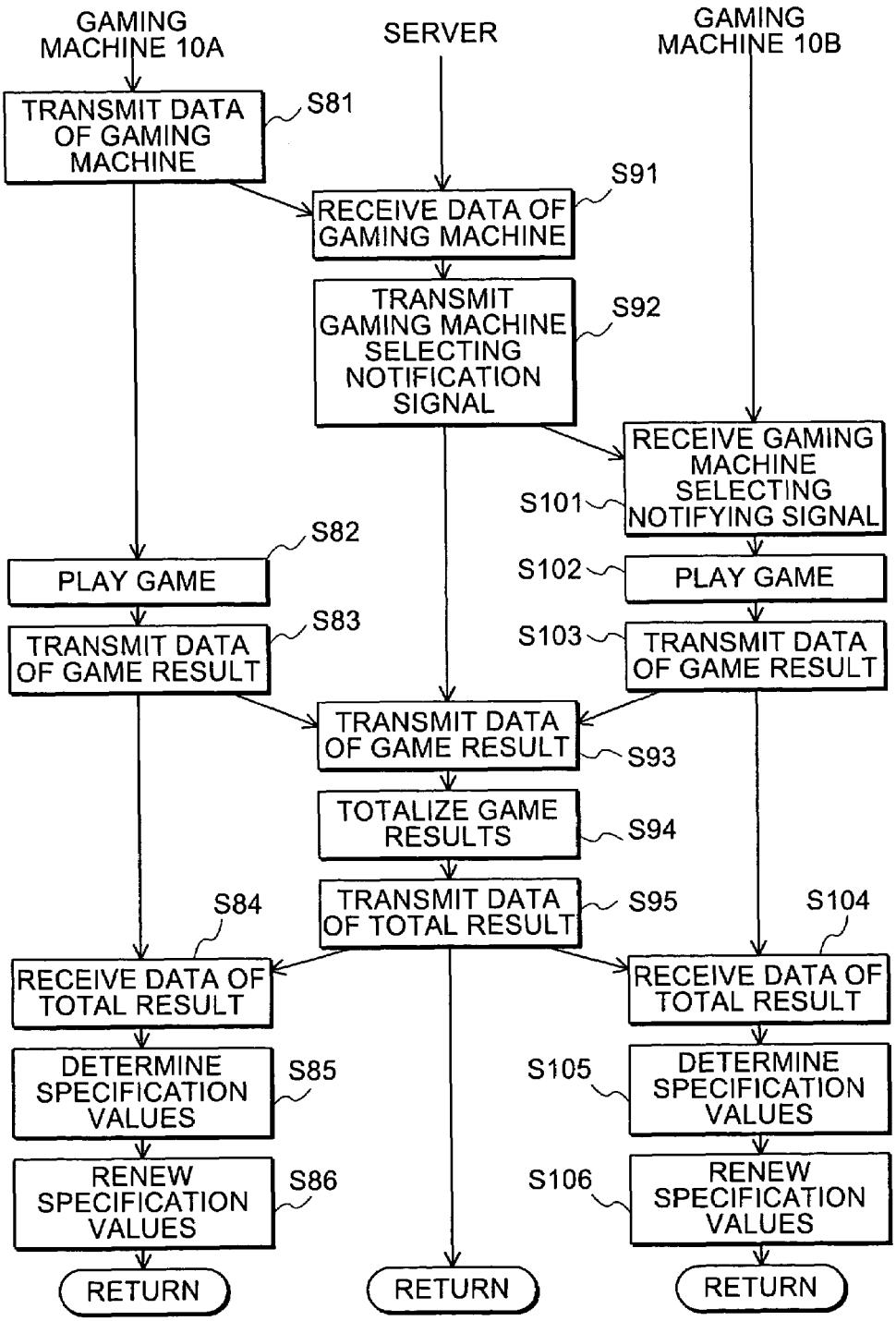
FIG. 21 is a flowchart of data communications between a server and two slot machines.

FIG. 21 shows the data communication between each of the two gaming machines 10A, 10B and the server 80. In the following description, the hardware of the gaming machine 10A is represented by adding the reference numerals with a character "A", and the hardware of the gaming machine 10B is represented by adding the reference numerals with a character B.

First, the gaming machine 10A executes gaming machine data transmission processing (step S81). In this processing, when the player operates the ten keys displayed on the display device 30 shown in FIG. 11, the gaming machine 10B with which the game player wants to play the game jointly is selected. That is, the gaming machine having a payout medal number with which the player wants to add his/her payout medal number is selected. A signal indicating that the gaming machine 10B is selected is transmitted through the interface circuit group 102A and the input-output bus 104A to CPU 106A. The CPU 106A transmits the data of the gaming machine 10A of the player concerned and the gaming machine 10B selected by the player concerned to the server 80. After finishing this processing, the CPU 106A shifts the processing to step S82.

The server 80 executes gaming machine data reception processing (step S91). In this processing, the CPU 82 receives the data of the gaming machine 10A of the player and the gaming machine 10B selected by the player. After finishing this processing, the CPU 82 shifts the processing to step S82.

Subsequently, the server 80 transmits a gaming machine selection notifying signal (step S92). In this processing, the CPU 82 transmits to the gaming machine 10B through the communication interface circuit 90 a signal indicating that there is a notification that the player of the gaming machine 10A wishes to jointly play with the gaming machine 10B. After finishing this processing, the CPU 82 shifts the processing to step S93.

The gaming machine 10B receives the gaming machine selection notifying signal (step S101). In this processing, the CPU 106B receives from the server 80 the signal indicating that there is a notification that the player of the gaming machine 10A wishes to jointly play with the gaming machine 10B. After finishing this processing, the CPU 106B shifts the processing to step S102.

Subsequently, the gaming machine 10B plays the game (step S102). In this processing, the processing shown in FIGS. 16 to 19 described above is carried out in the gaming machine 10B. After finishing this processing, the CPU 106B shifts the processing to step S103.

Subsequently, the CPU 106B transmits the data of the game result (step S103). In this processing, the CPU 106B transmits the data of the game result, that is, the data of the number of medals paid out for a predetermined period to the server 80 through the interface circuit group 102B and the input-output bus 104B. After finishing this processing, the CPU 106B shifts the processing to step S104.

Like the gaming machine 10B, the gaming machine 10A plays the game (step S82). In this processing, the processing shown in FIGS. 16 to 19 described above is carried out. After finishing this processing, the CPU 106A shifts the processing to step S83.

Subsequently, the CPU 106A transmits the data of the game result (step S83). In this processing, the CPU 106A transmits the data of the game result, that is, the data of the number of medals paid out for a predetermined period to the server 80 through the interface circuit group 102A and the input-output bus 104A. After finishing this processing, the CPU 106A shifts the processing to step S84.

The server 80 receives the data of the game results (step S93). In this processing, the CPU 82 receives from the gaming machines 10A and 10B the data of the game results, that is, the data of the payout medal numbers of the gaming machines 10A and 10B, and records the data into the RAM 86. After finishing this processing, the CPU 82 shifts the processing to step S94.

Subsequently, the server 80 totalizes the game results (step S94). In this processing, the CPU 82 adds the data of the payout medal numbers of the gaming machines 10A and 10B which are recorded in the RAM 86, and records the total result data into the RAM 86. After finishing this processing, the CPU 82 shifts the processing to step S95.

Subsequently, the server 80 transmits the total result data (step S95). In this processing, the CPU 82 transmits the total result data calculated in step S94 to the gaming machines 10A and 10B through the communication interface circuits 90A and 90B. After finishing this processing, the CPU 82 immediately finishes this sub routine.

The gaming machine 10A receives the total result data (step S84). In this processing, the CPU 106A receives from the server 80 the total result data transmitted through the processing of the step S95, that is, the data of the sum of the numbers of medals paid out to the gaming machines 10A and 10B. After finishing this processing, the CPU 106A shifts the processing to step S85.

Subsequently, the gaming machine 10A determines the specification values (step S85). In this processing, on the basis of the total result data received in step S84, the CPU 106A refers to the specification value determining table recorded in the ROM 108A and determines the specification values to be altered. After finishing this processing, the CPU 106A shifts the processing to step S86.

Subsequently, the gaming machine 10A renews the specification values (step S86). In this processing, the CPU 106A renews the probability data, the payout data and the payout rate data recorded in the RAM 110A to the corresponding specification values determined through the processing of the step S85. After finishing this processing, the CPU 106A immediately finishes this sub routine.

Like the gaming machine 10A, the gaming machine 10B also receives the total result data (step S104). In this processing, the CPU 106B receives from the server 80 the total result data transmitted through the processing of the step S95, that is, the data of the sum of the numbers of medals paid out to the gaming machines 10A and 10B. After finishing this processing, the CPU 106B shifts the processing to step S105.

Subsequently, the gaming machine 10B determines the specification values (step S105). In this processing, on the basis of the total result data received in step S104, the CPU 106B refers to the specification value determining table recorded in the ROM 108B and determines the specification values. After finishing this processing, the CPU 106B shifts the processing to step S106.

Subsequently, the gaming machine 10B renews the specification (step S106). In this processing, the CPU 106B renews the big-hit shift probability data, the payout data and the payout rate recorded in the RAM 110B to the corresponding specification values determined through the processing of the step S105. After finishing this processing, the CPU 106B immediately finishes this sub routine.

By carrying out the above-described processing shown in FIG. 21, the specification value is renewed on the basis of the total of the number of medals paid out to the gaming machines 10A and 10B. Specifically, if the total number of the payout medals is not less than a predetermined fixed number, the specification values are increased. On the other hand, if the total number of payout medals is less than the predetermined fixed number, the specification values are reduced. Accordingly, even when the number of medals paid out to one of jointly-played gaming machines is large, the specification values would be reduced (or depreciated) if the number of medals paid out to the other gaming machine is small, so that the next game play must be carried out under a more unfavorable condition than the preceding game play. Conversely, even when the number of medals paid out for one of the jointly-played gaming machines is small, the specification values would be increased (or improved) if the number of medals paid out to the other gaming machine is large, so that the next game play could be carried out under a more favorable condition that the preceding game play.

In the above embodiment, the gaming machines are designed so that the operations are carried out for the detailed setting by using the touch sensors 56. However, this invention is not limited to this mode, and an operating portion such as a switch or the like may be used in place of the touch sensor.

In the above embodiment, the slot machine with which the player operates the stop buttons so as to stop the reels is described. However, the present invention is not limited to this mode. The present applies to a slot machine for the casino such that the reels may automatically stop after they rotate for a certain period of time. Although the slot machine provided with mechanical reels is described in the above embodiment, it should be understood that the present invention may apply to the video slot machine.

Furthermore, in the above embodiment, a gaming machine which can be selected as a jointly-playing gaming machine (i.e., a partner gaming machine) is limited to only one gaming machine 10B. However, this invention is not limited to this mode, and plural gaming machines may be selected as partner gaming machines.

Furthermore, in the above embodiment, it is assumed that the player of a gaming machine that is requested to be jointly played necessarily participates in the joint game play irrespective of player's intention. However, this invention is not limited to this mode, and the gaming machine may be designed so that the joint player can reject the offer for playing the game jointly on the player's decision. For example, the gaming machine may be provided with an operating portion such as a switch so that the player may reject the offer.

Furthermore, in the above embodiment, the player is allowed to freely select a gaming machine with which the player wants to totalize the game results (i.e., a partner gaming machine). However, this invention is not limited to this mode, and it may be modified so that a gaming machine with which the game results are totalized (i.e., a partner gaming machine) has been already determined when the player plays the game. For example, a partner gaming machine(s) is/are predetermined at the manufacturing time thereof, or determined on the manager side of the arcade.

In the above embodiment, slot machines are used as the gaming machines. However, this invention is not limited to the slot machines, but it may be applied to pachinko machines or other types of gaming machines.

Furthermore, in the above embodiment, the server totalizes the game results, and transmits the total result to each gaming machine, however, this invention is not limited to this mode. For example, it may be modified so that the server merely receives the game result of each gaming machine and transmits the game result to the game result to the partner gaming machine(s), and the total of the game results is calculated at each gaming machine.

Furthermore, the specification value determining table shown in FIG. 7 is used, and the total of the payout medal numbers are associated with each other. However, this invention is not limited to this mode, and the specification values may be determined by using tables shown in FIGS. 23A and 23B. That is, FIG. 23A shows a table indicating the total result and the change of the specification values based on the total result, and FIG. 23B shows a table indicating the set number and the specification values (the big-hit shift probability, the payout, and the payout rate) for each set number. As the set number decreases, the specification values are more advantageous to the player. For example, it is assumed that the set number for the specification values is originally set to "8", and also a total result of "A5 to A6" is achieved when a game play is played jointly. At this time, the change is equal to "+2" as shown in FIG. 23A, and thus the set number of the specification values is enhanced to "6". The specification values may be determined in the manner as described above.

Furthermore, in the above embodiment, the specification values are determined by totalizing the number of medals paid out for a predetermined time period. However, this invention is not limited to this mode. For example, there may be used a mode for predetermining a score for each combination of symbols, and determining the specification values on the basis of comparison of the scores for combinations of symbols achieved after one game is played. Alternatively, there may be used a mode of determining the specification values on the basis of the total of results of a sub game different from the slot game or on the basis of comparison of game results achieved by other methods.

According to this invention, a game result of one player and a game result of other player may be totalized, and the specification values may be changed on the basis of the total result. Therefore, even when the game result of the one player is bad, the specification values may be increased or improved because the game result of the other player could be good. Accordingly, the player may have a sense of anticipation to the game although the his game result is bad. Furthermore, even when the game result of the player is good, the specification values may be reduced or depreciated because the game result of the other player could be bad. In order to avoid such situation, the players do their best to achieve a good game result. Accordingly, exciting and thrilling games can be provided.

What is claimed is:

1. A first gaming machine for transmitting/receiving data to/from a server, comprising:

a specification value setting device for setting at least one specification value as a control condition for game control;

a transmitting device for transmitting data of a game result to the server;

a gaming machine determining device for determining a second gaming machine operated by a co-player;

a total result data receiving device for receiving from the server data of a total game result achieved by the first gaming machine and the second gaming machine based on the data of the game result transmitted by the transmitting device;

a specification value determining device for determining a specification value based on the data of the total game result received by the total result data receiving device; and a specification value renewing device for renewing to replace the specification value set by the specification value setting device with the specification value determined by the specification value determining device.

2. The first gaming machine according to claim 1, wherein the gaming machine determining device determines a plurality of gaming machines including the second gaming machine.

3. The first gaming machine according to claim 2, wherein the total result data receiving device receives from the server data of a total game result and wherein the total game result is achieved by the plurality of gaming machines including the first and the second gaming machines.

4. A first gaming machine for transmitting/receiving data to/from a second gaming machine operated by a co-player, comprising:

a specification value setting device for setting at least one specification value as a control condition for game control;

a gaming machine determining device for determining the second gaming machine;

a receiving device for receiving from the second gaming machine data of a game result achieved by the second gaming machine;

a game result totalizing device for totalizing a game result achieved by the first gaming machine and the game result achieved by the second gaming machine based on the data of the game result of the second gaming machine received by the receiving device so as to calculate a total result;

a specification value determining device for determining a specification value based on the total result calculated by the game result totalizing device; and a specification value renewing device for renewing to replace the specification value set by the specification value setting device with the specification value determined by the specification value determining device.

5. The first gaming machine according to claim 4, wherein the gaming machine determining device determines a plurality of gaming machines operated by co-players including the second gaming machine and wherein the first gaming machine transmits and receives data to and from the plurality of gaming machines.

6. The first gaming machine according to claim 5, wherein the receiving device receives data of game results achieved by the plurality of gaming machines including the second gaming machine and wherein the game result totalizing device totalizes a game result achieved by the first gaming machine and the game results achieved by the plurality of gaming machines including the second gaming machines based on the data of the game results of the plurality of gaming machines received by the receiving device so as to calculate the total result.

7. The first gaming machine according to claim 1, further comprising a gaming machine selecting device for selecting the second gaming machine based on an operation by a game player, wherein the gaming machine determining device determines the second gaming machine based on a selection result by the gaming machine selecting device.

8. A server for transmitting/receiving data to/from a first gaming machine operated by a game player and a second gaming machine operated by a co-player, comprising:

a specification value setting device for setting at least one specification value as a control condition for game control with the first gaming machine;

a game result data receiving device for receiving data of a game result transmitted from the first gaming machine and data of a game result transmitted from the second gaming machine;

a game result totalizing device for totalizing the game result of the first gaming machine and the game result of the second gaming machine on the basis of the data of the game result transmitted from the first gaming machine and the data of the game result transmitted from the second gaming machine so as to calculate a total result wherein the data of the game results are received by the game result data receiving device;

a specification value determining device for determining a specification value based on the total result calculated by the game result totalizing device; and a determined specification value transmitting device for transmitting the specification value determined by the specification value determining device to the first gaming machine and the second gaming machine.

9. The server according to claim 8, wherein the server transmits and receives data to and from a plurality of gaming machines including the first and the second gaming machines.

10. The server according to claim 9, wherein the game result data receiving device receives data of game results transmitted from the plurality of gaming machines including the first and the second gaming machines.

11. A program stored on media for directing a computer of a first gaming machine for transmitting/receiving data to/from a server to perform:

setting at least one specification value as a control condition for game control with the first gaming machine;

transmitting data of a game result to the server;

determining a second gaming machine operated by a co-player;

receiving from the server data of a total result totalizing the game result achieved by the first gaming machine and a game result achieved by the second gaming machine;

determining a specification value based on the data of the total result; and renewing to replace the set specification value with the determined specification value.

12. The program according to claim 11, wherein the computer of the first gaming machine performs determining at least one gaming machine operated by another co-player other than the second gaming machine.

13. The program according to claim 12, wherein the computer of the first gaming machine performs receiving from the server data of the total result totalizing a game result achieved by the at least one gaming machine other than the second gaming as well as the game results achieved by the first and the second gaming machines.

14. The first gaming machine according to claim 1, wherein the specification value comprises a big-hit shift probability, a payout, a payout rate, or a combination thereof.

15. A method of renewing at least one specification value for a first gaming machine for transmitting/receiving data to/from a server, comprising:

setting a first specification value as a control condition for game control with the first gaming machine;

determining a second gaming machine operated by a co-player;

performing a game;

transmitting data of a game result to the server;

receiving from the server data of a total result totalizing the game result achieved by the first gaming machine and a game result achieved by the second gaming machine;

determining a second specification value based on the data of the total result; and renewing the specification value from the first specification value to the second specification value.

16. A method for setting a value associated with an award obtainable based on a game result from subsequent play of a game on a first gaming machine, comprising:

determining a total game result based on a first game result from prior play of a game on the first gaming machine and a second game result from prior play of a game on a second gaming machine; and setting the value in accordance with the determined total game result.

17. The method according to 16, wherein:

the value associated with the obtainable award is one of (i) a probability associated with an obtainable big prize payout, (ii) an amount associated with an obtainable regular payout based on a game result from subsequent play of a game on the first gaming machine and a game result from subsequent play of a game on the second gaming machine, and (iii) a rate associated with the obtainable regular payout.

18. The method according to 16, wherein:

the determining of the total game result includes summing the first result and the second result.

19. The method according to 16, wherein:

the prior played game on the first gaming machine and the prior played game on the second gaming machine are a same type game; and the value is set for subsequent play of the same type game on the first gaming.

20. The method according to 16, wherein:

setting the value includes modifying a prior value associated with the award obtainable based on the game result from the prior play of the game on the first gaming machine.

21. The method according to 20, wherein:

the prior value is modified to be (i) less favorable to a player of the first gaming machine, if an amount of the determined total game result is less than a threshold amount, and (ii) more favorable to the player of the first gaming machine, if the amount of the determined total game result is more than the threshold amount.

22. The method according to 21, wherein:

the threshold amount is a highest amount of a range of amounts extending from a lowest amount of the range to the highest amount; and the prior value is modified to be less favorable to the player of the first gaming machine, if the amount of the determined total game result is within the range of amounts.

23. The method according to 16, further comprising:

selecting the second gaming machine prior to determining the total game result.

24. The method according to 23, wherein:

the second gaming machine is selected by the first gaming machine in accordance with a predefined selection criteria.

25. The method according to 23, further comprising:

accepting, by a player of the second gaming machine, the selection of the second gaming machine by a player of the first gaming machine, prior to determining the total game result;

wherein the determining is performed based on the player of the second gaming machine accepting the selection of the second gaming machine.

26. The method according to 16, wherein the value is a first value, and further comprising:

setting a second value associated with an award obtainable based on a game result from subsequent play of a game on the second gaming machine, in accordance with the determined total game result.

27. The method according to 16, further comprising:

storing a table including predefined different values associated with the award obtainable based on different game results from play of a game on the first gaming machine, for different total game results;

wherein the value is set also in accordance with the stored table.

* * * * *